US012228351B2

(12) United States Patent
Morimoto et al.

(10) Patent No.: US 12,228,351 B2
(45) Date of Patent: Feb. 18, 2025

(54) HEAT EXCHANGER AND CORRUGATED FIN

(71) Applicant: DENSO CORPORATION, Kariya (JP)

(72) Inventors: Keita Morimoto, Kariya (JP); Tomohiko Nakamura, Kariya (JP); Mitsuyoshi Saito, Kariya (JP); Tatsuhiko Nishino, Kariya (JP); Shota Chatani, Kariya (JP); Toshiya Nagasawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 351 days.

(21) Appl. No.: 17/943,246

(22) Filed: Sep. 13, 2022

(65) Prior Publication Data

US 2023/0003467 A1 Jan. 5, 2023

Related U.S. Application Data

(60) Division of application No. 16/696,767, filed on Nov. 26, 2019, now abandoned, which is a continuation of (Continued)

(30) Foreign Application Priority Data

Jun. 12, 2017 (JP) ..... 2017-115290
May 31, 2018 (JP) ..... 2018-105208

(51) Int. Cl.
*F28F 17/00* (2006.01)
*F25B 39/02* (2006.01)

(Continued)

(52) U.S. Cl.
CPC ..... *F28F 17/005* (2013.01); *F28F 1/128* (2013.01); *F25B 39/02* (2013.01); *F28D 1/05383* (2013.01);

(Continued)

(58) Field of Classification Search
CPC . F28F 17/005; F28F 1/128; F28F 1/32; F28D 1/05383; F28D 1/05391; F28D 2021/0085; F25B 39/02
See application file for complete search history.

(56) References Cited

U.S. PATENT DOCUMENTS 4,328,861 A 5/1982 Cheong et al.
4,434,844 A 3/1984 Sakitani et al.

(Continued)

FOREIGN PATENT DOCUMENTS

CN 104964487 A 10/2015
JP S57162605 A 10/1982

(Continued)

OTHER PUBLICATIONS

U.S. Appl. No. 16/696,767, filed Nov. 26, 2019, Keita Morimoto.

*Primary Examiner* — Jon T. Schermerhorn, Jr.
(74) *Attorney, Agent, or Firm* — Harness, Dickey & Pierce, P.L.C.

(57) ABSTRACT

A heat exchanger includes tubes arranged in one direction, and a corrugated fin provided between the tubes. The corrugated fin includes joints joined to the tubes, and fin bodies that connect the joints which are located next to each other along the wave shape. The fin body includes a cut-raised portion that has a shape in which a part of the fin body is cut and raised for promotion of heat transfer. The cut-raised portion includes a cut-raised end on at least one end of the cut-raised portion in the one direction. The cut-raised end has recesses and projections on its surface that increase hydrophilicity of the surface of the cut-raised end.

10 Claims, 28 Drawing Sheets

Related U.S. Application Data application No. PCT/JP2018/021850, filed on Jun. 7, 2018.

(51) Int. Cl.

| | |
|---|---|
| ***F28D 1/053*** | (2006.01) |
| ***F28D 21/00*** | (2006.01) |
| ***F28F 1/12*** | (2006.01) |
| ***F28F 1/32*** | (2006.01) |

(52) U.S. Cl.

CPC .. *F28D 1/05391* (2013.01); *F28D 2021/0085* (2013.01); *F28F 1/32* (2013.01)

(56) References Cited

U.S. PATENT DOCUMENTS

| | | | | |
|---|---|---|---|---|
| 4,756,362 | A * | 7/1988 | Kudoh | F28F 1/128 165/151 |
| 4,892,143 | A | 1/1990 | Ishii | |
| 5,558,156 | A * | 9/1996 | Tsutsui | F28F 13/02 165/122 |
| 5,919,406 | A | 7/1999 | Bachofen | |
| 6,439,300 | B1 * | 8/2002 | Falta | F25D 21/14 165/152 |
| 7,021,370 | B2 * | 4/2006 | Papapanu | F28F 1/325 62/515 |
| 9,803,935 | B2 * | 10/2017 | Kamada | F25D 21/12 |
| 10,107,553 | B2 * | 10/2018 | Takagi | F28D 1/05325 |
| 2004/0003619 | A1 | 1/2004 | Lee et al. | |
| 2006/0169443 | A1 | 8/2006 | Ozaki | |
| 2007/0199686 | A1 | 8/2007 | Okinotani et al. | |
| 2014/0338876 | A1 | 11/2014 | Hokazono | |
| 2014/0352345 | A1 | 12/2014 | Hakbijl et al. | |
| 2015/0232681 | A1 | 8/2015 | Osako et al. | |
| 2016/0061475 | A1 | 3/2016 | Ito et al. | |
| 2020/0096226 | A1 | 3/2020 | Morimoto et al. | |

FOREIGN PATENT DOCUMENTS

| | | | |
|---|---|---|---|
| JP | S60194293 | A | 10/1985 |
| JP | H07019777 | A | 1/1995 |
| JP | 1026491 | A | 1/1998 |
| JP | 200460934 | A | 2/2004 |
| JP | 2004101074 | A | 4/2004 |
| JP | 2007232246 | A | 9/2007 |
| JP | 2013245883 | A | 12/2013 |
| JP | 2014098499 | A | 5/2014 |
| JP | 2014134311 | A | 7/2014 |
| JP | 5661202 | B2 | 1/2015 |
| JP | 2016102592 | A | 6/2016 |
| JP | 2016133248 | A | 7/2016 |
| JP | 2019002587 | A | 1/2019 |
| WO | WO-2014/147782 | A1 | 9/2014 |

* cited by examiner

HEAT EXCHANGER AND CORRUGATED FIN

CROSS REFERENCE TO RELATED APPLICATIONS

The present application is a divisional application of U.S. patent application Ser. No. 16/696,767 filed Nov. 26, 2019 which is a continuation application of International Patent Application No. PCT/JP2018/021850 filed on Jun. 7, 2018, which designated the U.S. and claims the benefit of priority from Japanese Patent Application No. 2017-115290 filed on Jun. 12, 2017, and Japanese Patent Application No. 2018-105208 filed on May 31, 2018.

TECHNICAL FIELD

The present disclosure relates to a heat exchanger and a corrugated fin.

BACKGROUND

Heat exchangers for performing heat exchange between fluids are conventionally known.

SUMMARY

According to at least one embodiment of the present disclosure, a heat exchanger performs heat exchange between a first fluid and a second fluid. The heat exchanger includes tubes which are arranged in one direction and in which the first fluid flows, and a corrugated fin provided between the tubes, curved to have a wave shape, and configured to promote heat exchange between the first fluid and the second fluid. The second fluid flows between the tubes. The corrugated fin includes joints that are joined to the tubes, and fin bodies that are each between and connect the joints which are located next to each other along the wave shape. The fin body includes a cut-raised portion that has a shape in which a part of the fin body is cut and raised for promotion of heat transfer. The cut-raised portion includes a cut-raised body that guides the second fluid, and a cut-raised end that is provided on at least one end of the cut-raised portion in the one direction and has a plate shape extending from the cut-raised body. The cut-raised end has recesses and projections that increase hydrophilicity of a surface of the cut-raised end on at least one side of the cut-raised end in a thickness direction of the cut-raised end.

DETAILED DESCRIPTION

Figure 1:
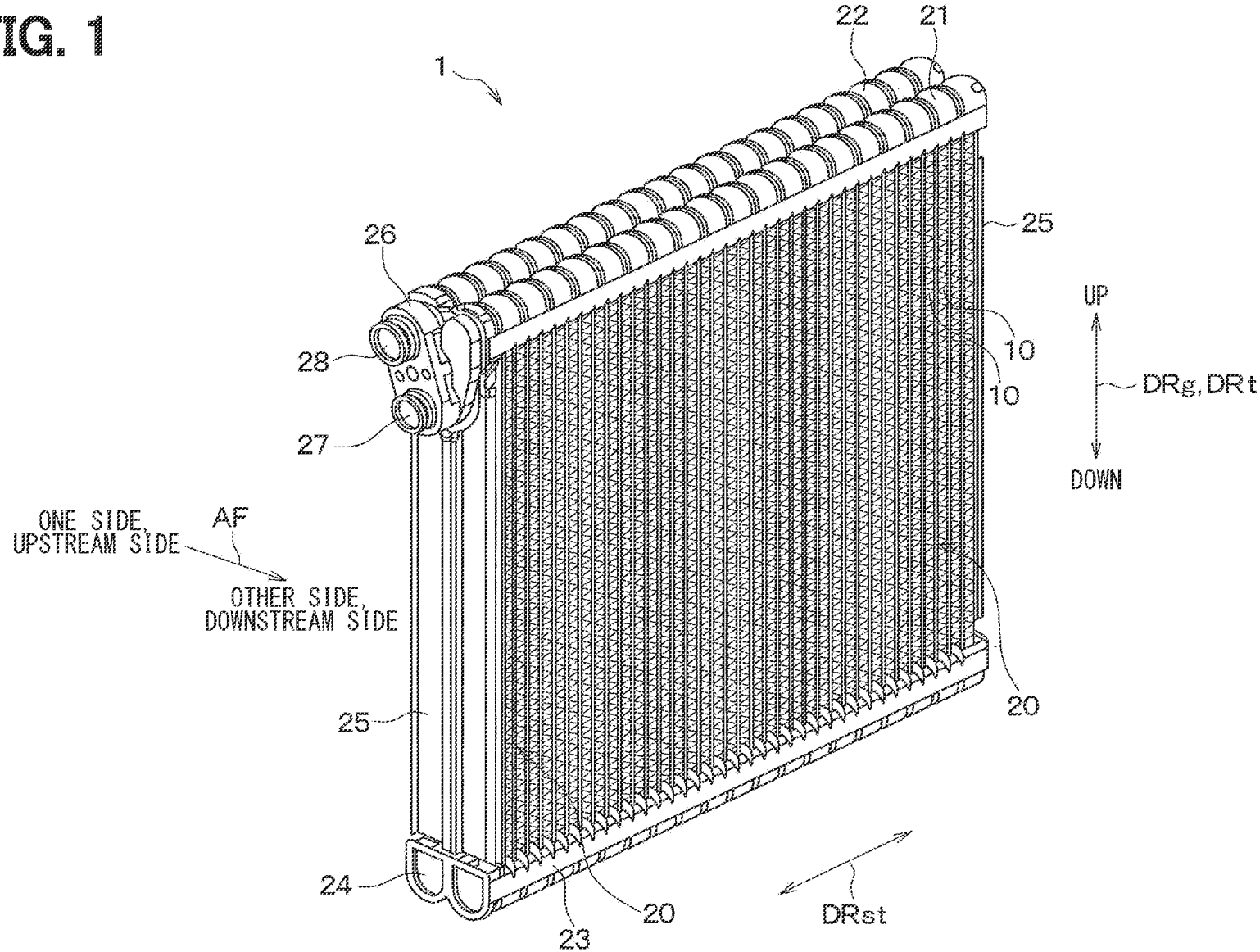
FIG. 1 is a perspective view of a heat exchanger according to at least one embodiment.

Each embodiment will now be described with reference to the drawings. Parts that are identical or equivalent to each other in the following embodiments are assigned the same reference numerals in the drawings.

A heat exchanger 1 of the present embodiment is, for example, used as an evaporator that forms a part of a refrigeration cycle performing air conditioning in a vehicle compartment. The evaporator performs heat exchange between refrigerant as a first fluid circulating in the refrigeration cycle and air as a second fluid passing through the heat exchanger 1, and cools the air by the latent heat of vaporization of the refrigerant. Arrow DRg in FIG. 1 indicates an up-down direction DRg of the heat exchanger 1.

Figure 2:
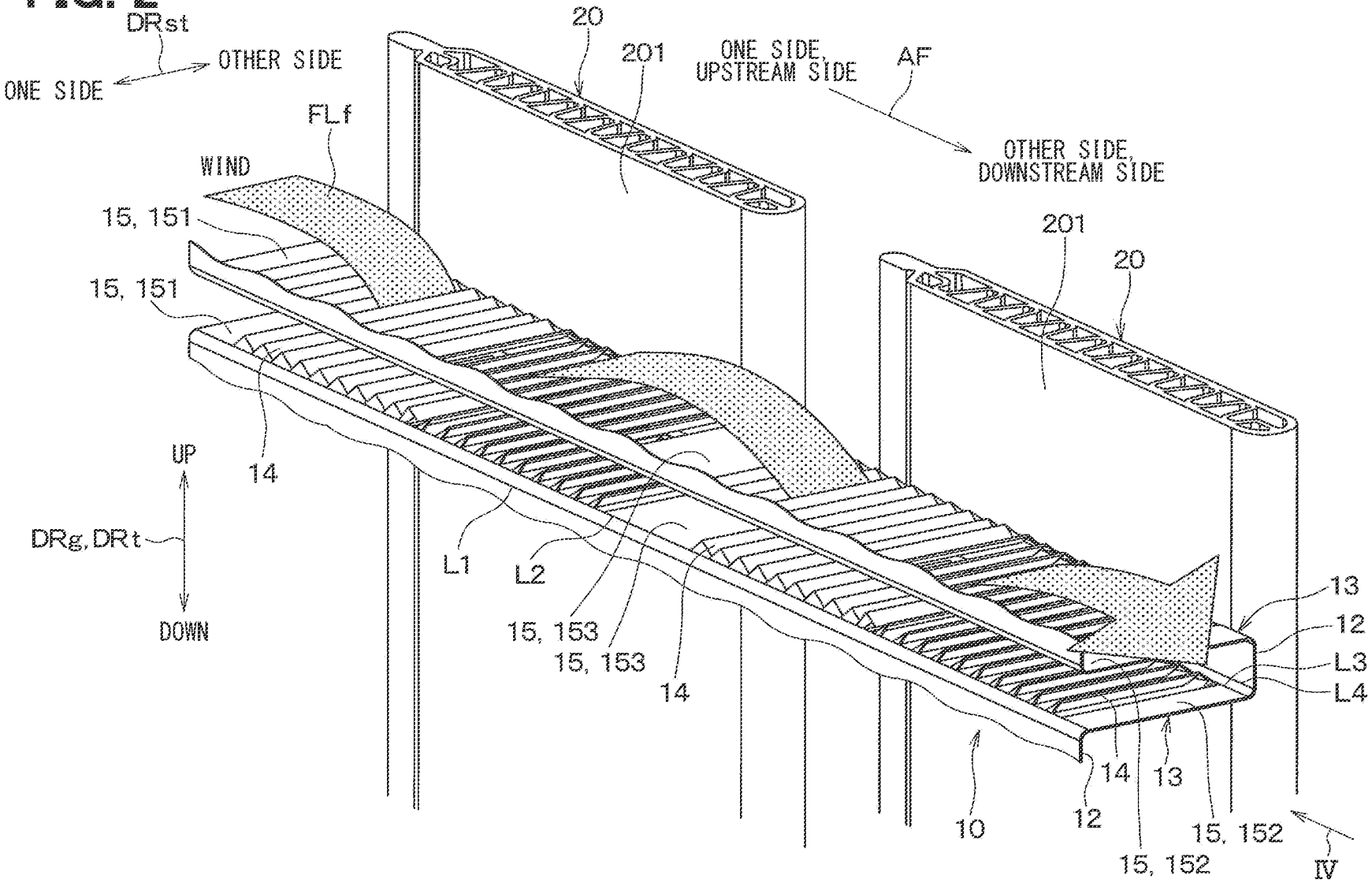
FIG. 2 is an enlarged perspective view of a part of a tube and a corrugated fin of the heat exchanger of FIG. 1.

As illustrated in FIGS. 1 and 2, the heat exchanger 1 includes a plurality of corrugated fins 10, a plurality of tubes 20, first to fourth header tanks 21 to 24, an outer frame member 25, a pipe connection member 26, and the like. These members are made of aluminum alloy, for example, and are joined together by brazing. Although a plurality of grooves 12*b* to 15*c* is formed on the surface of the corrugated fin 10 as described later, FIG. 2 omits the grooves 12*b* to 15*c* for the purpose of clear illustration.

The plurality of tubes 20 is arranged side by side at predetermined intervals in a tube arrangement direction DRst. The air passing through the heat exchanger 1 flows among the plurality of tubes 20. The air flows among the tubes 20 from one side in an air passage direction AF as an upstream side to the other side in the air passage direction AF as a downstream side. The air passage direction AF is one cross direction crossing the tube arrangement direction DRst which is one direction.

Moreover, the air passing through the heat exchanger 1 is cooled by the refrigerant to generate condensed water while flowing among the tubes 20. That is, the air passing through the heat exchanger 1 is a gas that generates condensed water by heat exchange with the refrigerant.

The plurality of tubes 20 is arranged in two rows corresponding to one side and the other side of the air passage direction AF. Each of the plurality of tubes 20 linearly extends in a tube extending direction DRt from one end to the other end. The tube extending direction DRt need not necessarily coincide with the up-down direction DRg but coincides with the up-down direction DRg in the present embodiment. In short, all the tubes 20 of the present embodiment extend in the up-down direction DRg, that is, in a vertical direction. The air passage direction AF, the tube arrangement direction DRst, and the tube extending direction DRt are directions intersecting one another, strictly speaking, directions orthogonal to one another.

The plurality of tubes 20 is inserted into the first header tank 21 or the second header tank 22 at upper ends, and inserted into the third header tank 23 or the fourth header tank 24 at lower ends. The first to fourth header tanks 21 to 24 distribute the refrigerant to the plurality of tubes 20 and collect the refrigerant flowing in from the plurality of tubes 20.

The air flows among the plurality of tubes 20 so that gaps formed among the tubes 20 are air passages through which the air flows. The corrugated fins 10 are provided in the air passages. In other words, the corrugated fins 10 are provided among the tubes 20. The corrugated fins 10 of the present embodiment are thus outer fins provided outside the tubes 20.

The corrugated fins 10 promote heat exchange between the refrigerant flowing inside the tubes 20 and the air flowing among the tubes 20. Specifically, the corrugated fins 10 increase a heat transfer area between the refrigerant flowing inside the tubes 20 and the air flowing outside the tubes 20, thereby increasing a heat exchange efficiency between the refrigerant and the air.

A pair of the outer frame members 25 is provided on the outside of the portion where the plurality of tubes 20 and the plurality of corrugated fins 10 are alternately arranged in the tube arrangement direction DRst. The pipe connection member 26 is fixed to one of the pair of outer frame members 25.

The pipe connection member 26 is provided with a refrigerant inlet 27 through which the refrigerant is supplied, and a refrigerant outlet 28 through which the refrigerant is discharged. The refrigerant flowing into the first header tank 21 through the refrigerant inlet 27 flows through the first to fourth header tanks 21 to 24 and the plurality of tubes 20 in a predetermined path, and flows out of the refrigerant outlet 28. At that time, the latent heat of vaporization of the refrigerant flowing through the first to fourth header tanks 21 to 24 and the plurality of tubes 20 cools the air flowing through the air passages in which the corrugated fins 10 are provided.

Figure 3:
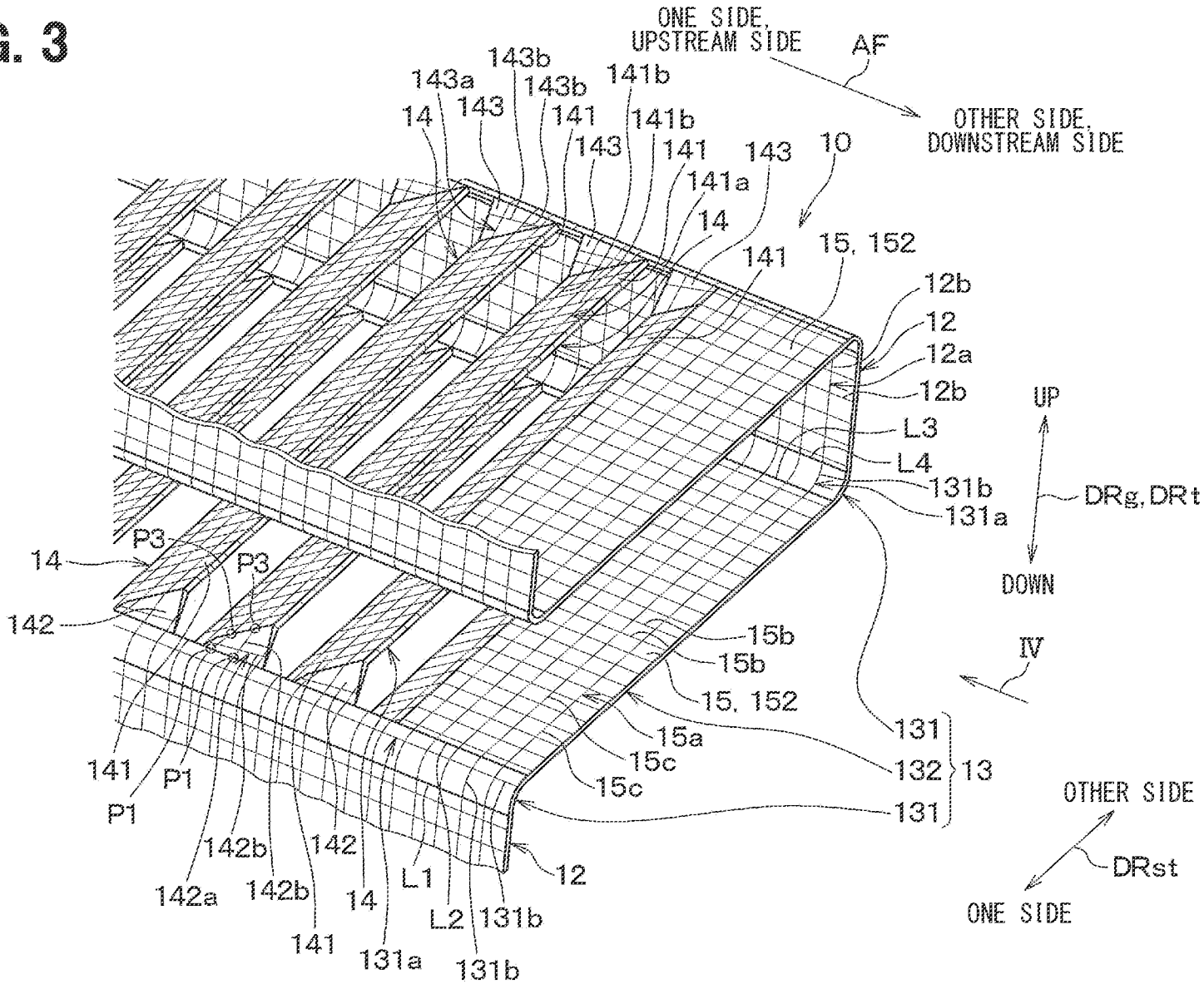
FIG. 3 is an enlarged perspective view of a part of the corrugated fin of FIG. 2 extracted in isolation.
Figure 4:
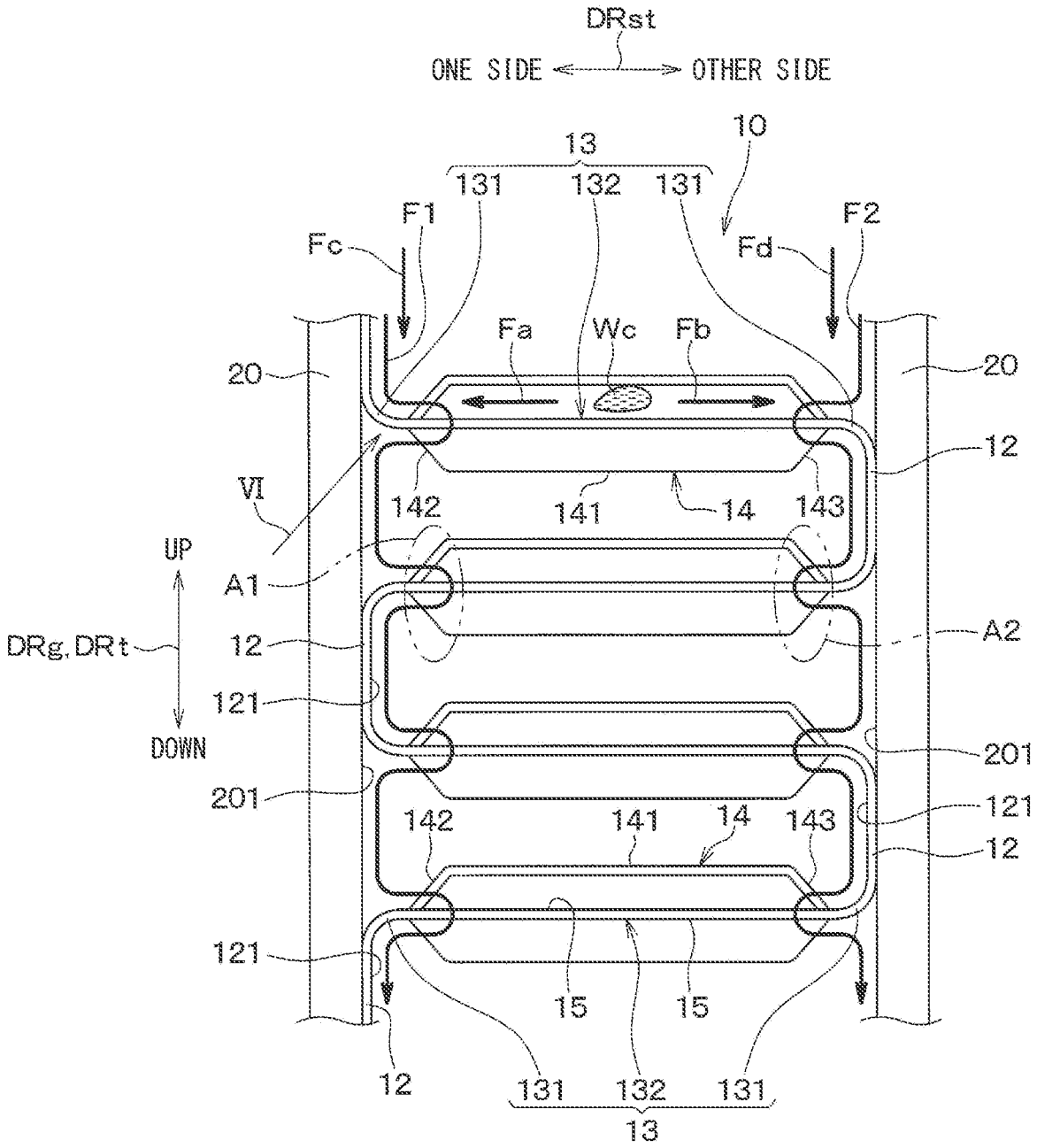
FIG. 4 is a view in the direction of arrow IV in FIG. 2.

As illustrated in FIGS. 3 and 4, the corrugated fin 10 is formed by bending a plate-like plate member or the like. Specifically, the corrugated fin 10 is bent to form a continuous wave shape in the tube extending direction DRt.

The corrugated fin 10 has a plurality of joints 12 and a plurality of fin bodies 13. Each of the plurality of joints 12 forms a crest of the wave shape of the corrugated fin 10 and is joined to a tube wall surface 201 which is a side surface of the tube 20 facing the tube arrangement direction DRst. That is, between surfaces of the joint 12 on both sides in the thickness direction, a surface 121 on the side opposite to the side joined to the tube 20 is exposed to the air passage formed between the tubes 20. The joint 12 and the tube 20 are joined specifically by brazing. The joint 12 forms the crest of the wave shape of the corrugated fin 10 and is thus also called a fin top portion.

The fin body 13 is disposed between the joints 12 next to each other along the wave shape of the corrugated fin 10, and is connected to each of the joints 12 to link the joints 12 together.

The fin body 13 is curved at both ends thereof in the tube arrangement direction DRst. That is, the fin body 13 includes a pair of curved connections 131 provided at both ends of the fin body 13 in the tube arrangement direction DRst, and a middle body portion 132 provided between the pair of curved connections 131. The pair of curved connections 131 is curved and connected to the joints 12 on both sides of the fin body 13.

Solid lines L1, L2, L3, and L4 in FIG. 3 are virtual lines indicating boundaries among the joint 12, the curved connection 131, the middle body portion 132, and the louver 14, and do not indicate a specific shape such as a groove. The similar is true for other perspective views such as FIG. 2 illustrating the corrugated fin 10.

The fin body 13 includes a plurality of louvers 14 that has a shape formed by cutting and raising a part of the fin body 13. The plurality of louvers 14 is arranged side by side in the air passage direction AF.

The plurality of louvers 14 is included in the middle body portion 132 of the fin body 13. The louver 14 has a louver body portion 141 including a central portion of the louver 14 in the tube arrangement direction DRst, one louver end 142, and the other louver end 143. In the present embodiment, the one louver end 142 and the other louver end 143 are collectively referred to as louver ends 142 and 143.

In a broader concept, the louver 14 is a cut-raised portion 14 for promoting heat transfer between the corrugated fin 10 and the air in contact with the corrugated fin 10. Accordingly, the louver body portion 141 may be referred to as a cut-raised body 141, the one louver end 142 may be referred to as one cut-raised end 142, and the other louver end 143 may be referred to as the other cut-raised end 143. Moreover, the one cut-raised end 142 and the other cut-raised end 143 may be collectively referred to as cut-raised ends 142 and 143.

The louver body portion 141 has a flat plate shape tilted with respect to the air passage direction AF and guides the air along the louver body portion 141.

The one louver end 142 has a plate shape extending from the louver body portion 141 to one side in the tube arrangement direction DRst, and is provided at an end of the louver 14 on one side in the tube arrangement direction DRst. The one louver end 142 is formed such that the thickness direction of the one louver end 142 intersects the thickness direction of the louver body portion 141.

The one louver end 142 is connected to the curved connection 131 of the fin body 13 forming a portion around the louver 14 on the side opposite to the side of the louver body portion 141 in the tube arrangement direction DRst. The curved connection 131 to which the one louver end 142 is connected is one on one side in the tube arrangement direction DRst of the pair of curved connections 131 arranged with the middle body portion 132 interposed therebetween.

The other louver end 143 has a plate shape extending from the louver body portion 141 to the other side in the tube arrangement direction DRst, and is provided at an end of the louver 14 on the other side in the tube arrangement direction DRst. That is, in view of the arrangement of the one louver end 142 and the other louver end 143, the louver ends 142 and 143 are arranged to form a pair with the louver body portion 141 interposed therebetween, and are provided at both ends of the louver 14 in the tube arrangement direction DRst.

The other louver end 143 is formed such that the thickness direction of the other louver end 143 intersects the thickness direction of the louver body portion 141.

The other louver end 143 is connected to the curved connection 131 of the fin body 13 forming the portion around the louver 14 on the side opposite to the side of the louver body portion 141 in the tube arrangement direction DRst. The curved connection 131 to which the other louver end 143 is connected is one on the other side in the tube arrangement direction DRst of the pair of curved connections 131 arranged with the middle body portion 132 interposed therebetween.

Moreover, as illustrated in FIGS. 2 and 3, all the louvers 14 included in one fin body 13 are divided into four louver groups. Each louver group includes a plurality of the louvers 14 in which the louver body portions 141 are provided in parallel with one another at predetermined intervals.

The plurality of louvers 14 forming the four louver groups as a whole guides the air passing through the heat exchanger 1 such that the air meanders as indicated by arrow FLf in FIG. 2. In other words, the air flowing as indicated by arrow FLf meanders while passing between the louvers 14. As the air flows in such a meandering manner, the heat exchange performance between the refrigerant and the air is improved.

The middle body portion 132 of the fin body 13 includes the plurality of louvers 14 described above, but a region excluding the louvers 14 is formed in the shape of a flat plate. Specifically, the middle body portion 132 has a plurality of flat surfaces 15 formed along the air passage direction AF. The plurality of flat surfaces 15 is arranged side by side with respect to the louvers 14 in the air passage direction AF. That is, the plurality of flat surfaces 15 includes one flat surface 151 provided at an end of the middle body portion 132 on one side in the air passage direction AF, the other flat surface 152 provided at an end of the middle body portion 132 on the other side in the air passage direction AF, and a middle flat surface 153. The middle flat surface 153 is provided between the plurality of louvers 14 formed in the middle body portion 132.

Figure 5:
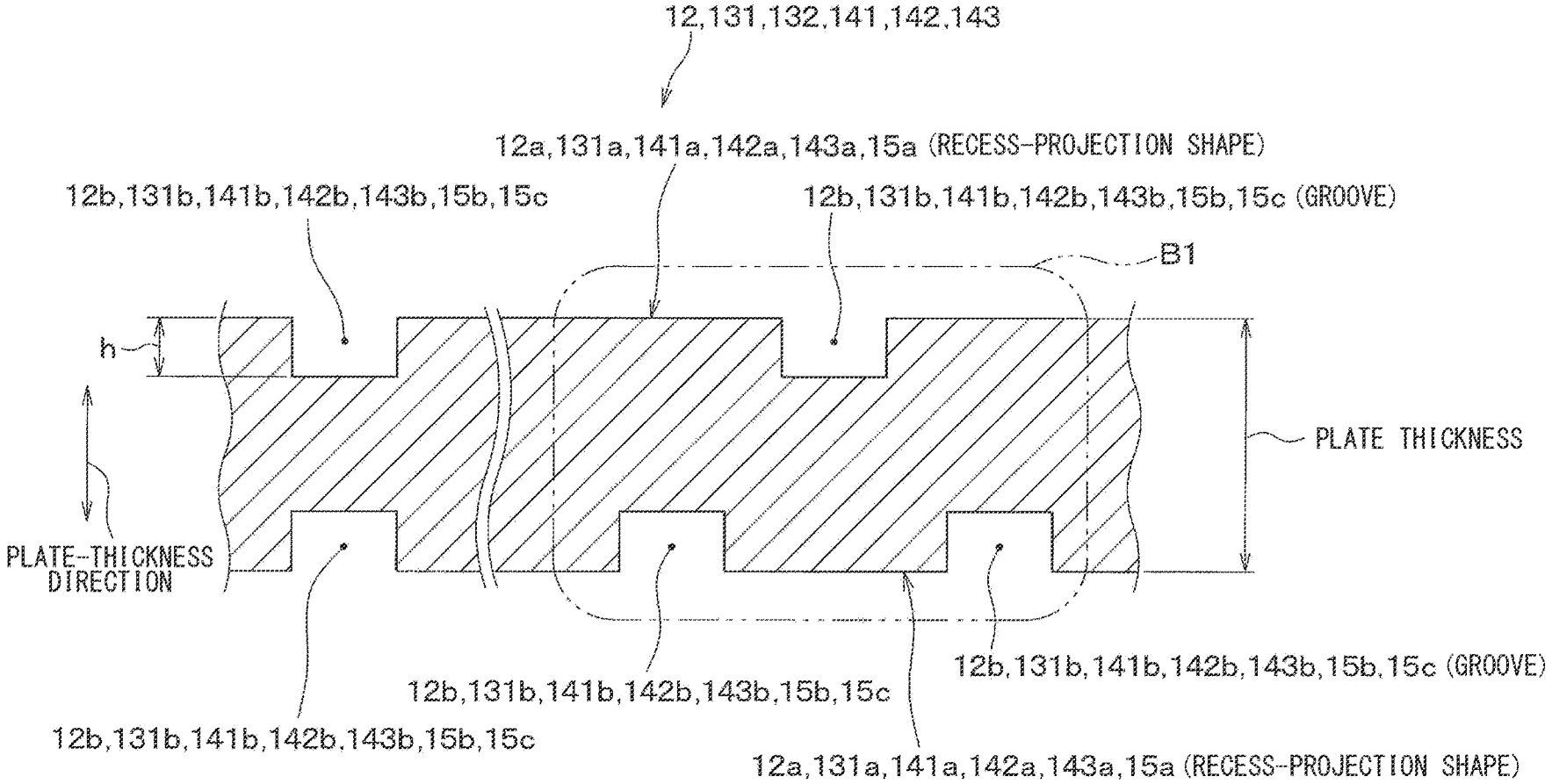
FIG. 5 is a schematic cross-sectional view of the corrugated fin of FIG. 2 cut along a plane parallel to the thickness direction, and a view illustrating the depth of a groove formed on the surface of the corrugated fin.

As illustrated in FIGS. 3 and 5, the surface of the corrugated fin 10 (specifically, the surfaces on both sides in the thickness direction) has hydrophilic recesses and projections 12*a*, 131*a*, 141*a*, 142*a*, 143*a*, and 15*a* which are recesses and projections formed to increase the hydrophilicity of the surfaces. The hydrophilic recesses and projections 12*a*, 131*a*, 141*a*, 142*a*, 143*a*, and 15*a* on the surface of the corrugated fin 10 are formed over the entire surface of the corrugated fin 10. Specifically, the formation of the recesses and projections to increase the hydrophilicity of the surface means forming the recesses and projections to increase the hydrophilicity of the surface as compared to the case where the surface is a smooth surface without the recesses and projections. The hydrophilic recesses and projections 12*a*, 131*a*, 141*a*, 142*a*, 143*a*, and 15*a* may be abbreviated as the hydrophilic recesses and projections 12*a* to 15*a*.

The hydrophilic recesses and projections 12*a* to 15*a* on the surface of the corrugated fin 10 include a plurality of grooves 12*b*, 131*b*, 141*b*, 142*b*, 143*b*, 15*b*, and 15*c* formed side by side at predetermined intervals. The plurality of grooves 12*b*, 131*b*, 141*b*, 142*b*, 143*b*, 15*b*, and 15*c* includes a groove extending in a predetermined first direction and a groove extending in a predetermined second direction intersecting the first direction.

Therefore, the plurality of grooves 12*b*, 131*b*, 141*b*, 142*b*, 143*b*, 15*b*, and 15*c* forming the hydrophilic recesses and projections 12*a* to 15*a* is recesses included in the hydrophilic recesses and projections 12*a* to 15*a*. The plurality of grooves 12*b*, 131*b*, 141*b*, 142*b*, 143*b*, 15*b*, and 15*c* may be abbreviated as the plurality of grooves 12*b* to 15*c*. In each of the drawings referred to in the present embodiment, the plurality of grooves 12*b* to 15*c* provided on the surface of the corrugated fin 10 is schematically enlarged for the purpose of description. The similar is true for each drawing described later that illustrates the grooves 12*b* to 15*c*.

Specifically, with regard to each portion of the corrugated fin 10, the joint 12 has the hydrophilic recesses and projections 12*a*, which is the recesses and projections formed to increase the hydrophilicity of the surface of the joint 12, on the side opposite to the side joined to the tube 20 in the thickness direction of the joint 12. The hydrophilic recesses and projections 12*a* includes the plurality of grooves 12*b* formed on the surface 121 of the joint 12 on the side opposite to the side joined to the tube.

In the corrugated fin 10 in isolation, the joint 12 also has the hydrophilic recesses and projections 12*a* on the side joined to the tube 20 in the thickness direction of the joint 12. However, the joint 12 is joined to the tube 20 in the heat exchanger 1 so that the hydrophilic recesses and projections 12*a* provided on the joined side of the joint 12 is mostly covered by the tube 20.

The one louver end 142 has the hydrophilic recesses and projections 142*a*, which is the recesses and projections formed to increase the hydrophilicity of the surface of the one louver end 142, on each of both sides in the thickness direction of the one louver end 142. The hydrophilic recesses and projections 142*a* includes the plurality of grooves 142*b* formed on the surface of the one louver end 142.

The other louver end 143 has the hydrophilic recesses and projections 143*a*, which is the recesses and projections formed to increase the hydrophilicity of the surface of the other louver end 143, on each of both sides in the thickness direction of the other louver end 143. The hydrophilic recesses and projections 143*a* includes the plurality of grooves 143*b* formed on the surface of the other louver end 143.

The louver body portion 141 has the hydrophilic recesses and projections 141*a*, which is the recesses and projections formed to increase the hydrophilicity of the surface of the louver body portion 141, on each of both sides in the thickness direction of the louver body portion 141. The hydrophilic recesses and projections 141*a* includes the plurality of grooves 141*b* formed on the surface of the louver body portion 141. At least any of the plurality of grooves 141*b* provided in the louver body portion 141 is formed to extend in the tube arrangement direction DRst.

The pair of curved connections 131 each has the hydrophilic recesses and projections 131*a*, which is the recesses and projections formed to increase the hydrophilicity of the surface of the curved connection 131, on each of both sides in the thickness direction of the curved connection 131. The hydrophilic recesses and projections 131*a* include the plurality of grooves 131*b* formed on the surface of the curved connection 131.

Each of the flat surfaces 15 of the fin body 13 has the hydrophilic recesses and projections 15*a* which is the recesses and projections formed to increase the hydrophilicity of the flat surface 15. The hydrophilic recesses and projections 15*a* include the plurality of grooves 15*b* and 15*c* formed on the flat surface 15. The grooves included in the plurality of grooves 15*b* and 15*c* formed to increase the hydrophilicity of the flat surface 15 intersect with one another. Specifically, the plurality of grooves 15*b* and 15*c* of the flat surface 15 includes a plurality of first flat surface grooves 15*b* and a plurality of second flat surface grooves 15*c*.

The plurality of first flat surface grooves 15*b* is lateral grooves extending in the air passage direction AF. On the other hand, the plurality of second flat surface grooves 15*c* is longitudinal grooves extending in the tube arrangement direction DRst. The plurality of first flat surface grooves 15*b* thus extends to intersect the plurality of second flat surface grooves 15*c*. As one can see, this is true for all of the one flat surface 151, the other flat surface 152, and the middle flat surface 153. The above description that the grooves included in the plurality of grooves 15*b* and 15*c* of the flat surface 15 intersect with one another is true for each portion of the corrugated fin 10 besides the flat surface 15.

The plurality of grooves 12*b* to 15*c* on the surface of the corrugated fin 10 is formed before the corrugated fin 10 is formed into the wave shape, for example. Thus, as illustrated in FIG. 3, the plurality of grooves 12*b* to 15*c* on the surface of the corrugated fin 10 includes grooves extending continuously over the plurality of portions 12, 131, 132, 141, 142, and 143 that forms the corrugated fin 10.

Specifically, at least any of the plurality of grooves 142*b* of the one louver end 142 is connected to at least any of the plurality of grooves 131*b* of one curved connection 131 of the pair of curved connections 131 closer to the one louver end 142. This is true for both sides of the one louver end 142. This is also true for the relationship between the plurality of grooves 143*b* of the other louver end 143 and the plurality of grooves 131*b* of the other curved connection 131 of the pair of curved connections 131 closer to the other louver end 143.

Specifically, among the plurality of grooves 141*b*, 142*b*, and 143*b* of the louver 14, grooves reaching a region adjacent to the louver are all connected to any of grooves in the region adjacent to the louver. The region adjacent to the louver is a region around the louver 14 and adjacent to the louver 14, and the pair of curved connections 131 and the plurality of flat surfaces 15 each correspond to the region adjacent to the louver as illustrated in FIG. 3.

Focusing on the one louver end 142 of the louver 14, the one curved connection 131 described above is adjacent to the one louver end 142. Among the plurality of grooves 142*b* of the one louver end 142, grooves reaching the one curved connection 131 described above are all connected to any of the grooves 131*b* of the one curved connection 131.

Likewise, focusing on the other louver end 143, the other curved connection 131 described above is adjacent to the other louver end 143. Among the plurality of grooves 143*b* of the other louver end 143, grooves reaching the other curved connection 131 described above are all connected to any of the grooves 131*b* of the other curved connection 131.

At least any of the plurality of grooves 142*b* of the one louver end 142 is connected to at least any of the plurality of grooves 141*b* of the louver body portion 141. At the other louver end 143 as well, at least any of the plurality of grooves 143*b* of the other louver end 143 is connected to at least any of the plurality of grooves 141*b* of the louver body portion 141.

Figure 6:
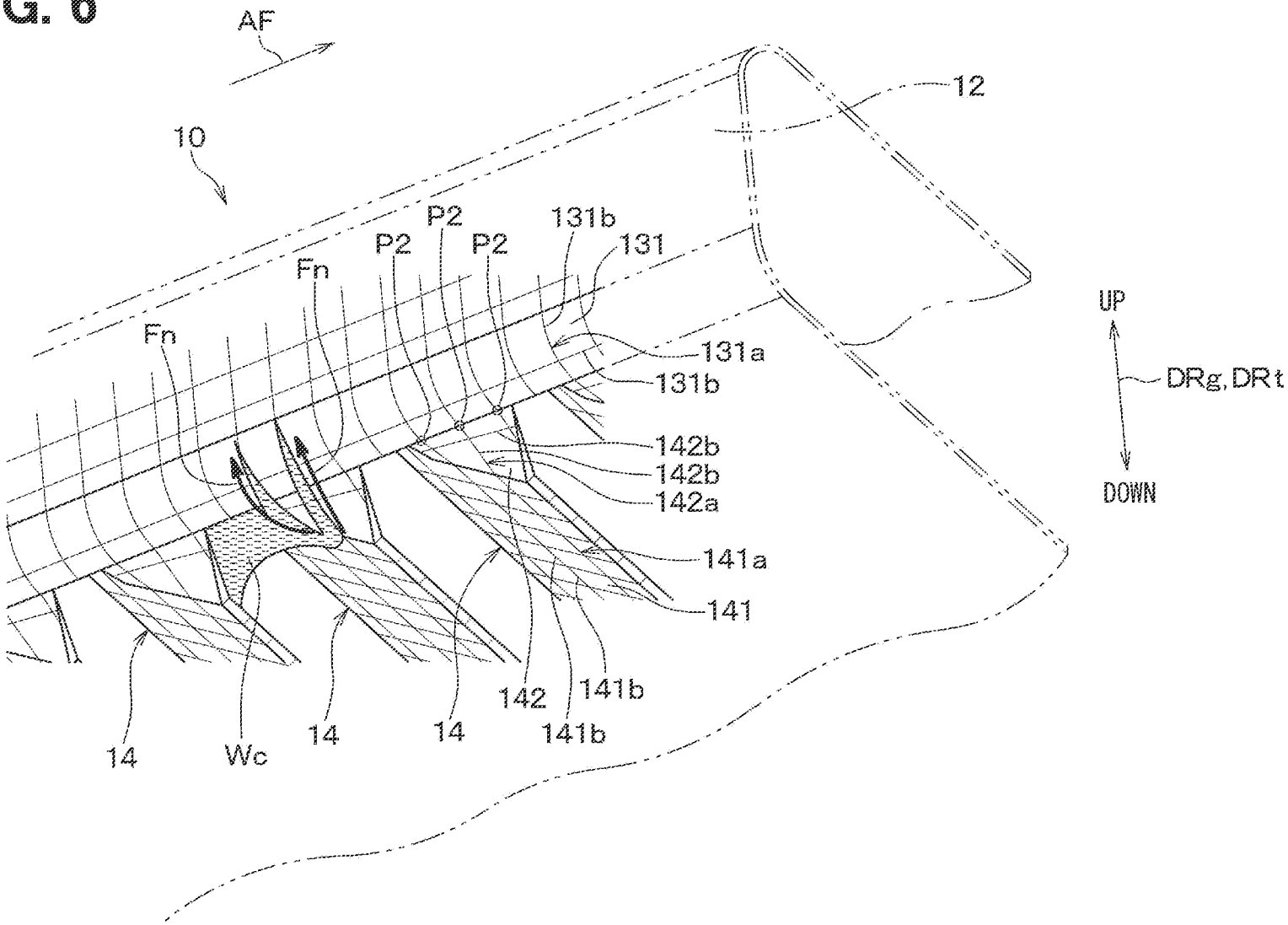
FIG. 6 is an enlarged perspective view of a part of the corrugated fin of FIG. 2 extracted in isolation and viewed in the direction of arrow VI in FIG. 4.

For example, in part P1 of FIG. 3 and part P2 of FIG. 6, the groove 131*b* of the one curved connection 131 and the groove 142*b* of the one louver end 142 are connected to each other. In part P3 of FIG. 3, the groove 141*b* of the louver body portion 141 and the groove 142*b* of the one louver end 142 are connected to each other. A two dot dashed line of FIG. 6 represents the schematic shape of the corrugated fin 10.

As illustrated in FIG. 5, a depth h of the recesses included in the hydrophilic recesses and projections 12*a* to 15*a*, that is, a groove depth h of the grooves 12*b* to 15*c*, is 10 μm or deeper, for example. Regarding the flat surface 15 of the fin body 13, for example, the groove depth h of the plurality of first flat surface grooves 15*b* is 10 μm or deeper, and the groove depth h of the plurality of second flat surface grooves 15*c* is also 10 μm or deeper.

As a result, the hydrophilicity of the surface of the corrugated fin 10 can be sufficiently high. When the hydrophilicity of the surface of the corrugated fin 10 is high, the drainage performance of the corrugated fin 10 is improved so that the condensed water does not stagnate on the surface of the corrugated fin 10. This prevents an increase in the air flow resistance of the air passage due to the stagnation of the condensed water, whereby the heat exchanger 1 can increase the heat exchange performance.

Next, the flow of condensed water generated from the air cooled by the refrigerant will be described. As illustrated in FIG. 4, with the tubes 20 disposed along the up-down direction DRg, the condensed water flows from the upper side to the lower side as indicated by arrows F1 and F2 along the joint 12 and the tube wall surface 201 of the corrugated fin 10 and is drained to the outside of the heat exchanger 1 from the lower part of the heat exchanger 1.

At this time, the fin body 13 crosses the air passage between the tubes 20, so that the condensed water flowing as indicated by arrow F1 passes the surface of the one louver end 142 and at the same time passes through the gap formed between the louvers 14. Similarly, the condensed water flowing as indicated by arrow F2 passes the surface of the other louver end 143 and at the same time passes through the gap formed between the louvers 14. For example, in area A1 of FIG. 4, the condensed water flowing as indicated by arrow F1 passes the surface of the one louver end 142 and passes over the one louver end 142. In area A2, the condensed water flowing as indicated by arrow F2 passes the surface of the other louver end 143 and passes over the other louver end 143.

The condensed water is mainly generated in the louver 14 because the heat exchange between the refrigerant and the air is promoted in the louver 14. For example, condensed water We adhering to the louver body portion 141 of the louver 14 wets and spreads on the surface of the louver body portion 141 as indicated by arrows Fa and Fb.

The condensed water generated in such a manner in the louver body portion 141 joins the condensed water flowing from the upper side as indicated by arrow Fc at the one louver end 142, and flows to the tube wall surface 201 or the joint 12. The condensed water generated in the louver body portion 141 also joins the condensed water flowing from the upper side as indicated by arrow Fd at the other louver end 143, and flows to the tube wall surface 201 or the joint 12.

Considering the flow of the condensed water as described above, the corrugated fin 10 needs to ensure satisfactory drainage to the tube wall surface 201 and the joint 12 for the flow of the condensed water indicated by arrows F1 and F2.

Figure 7:
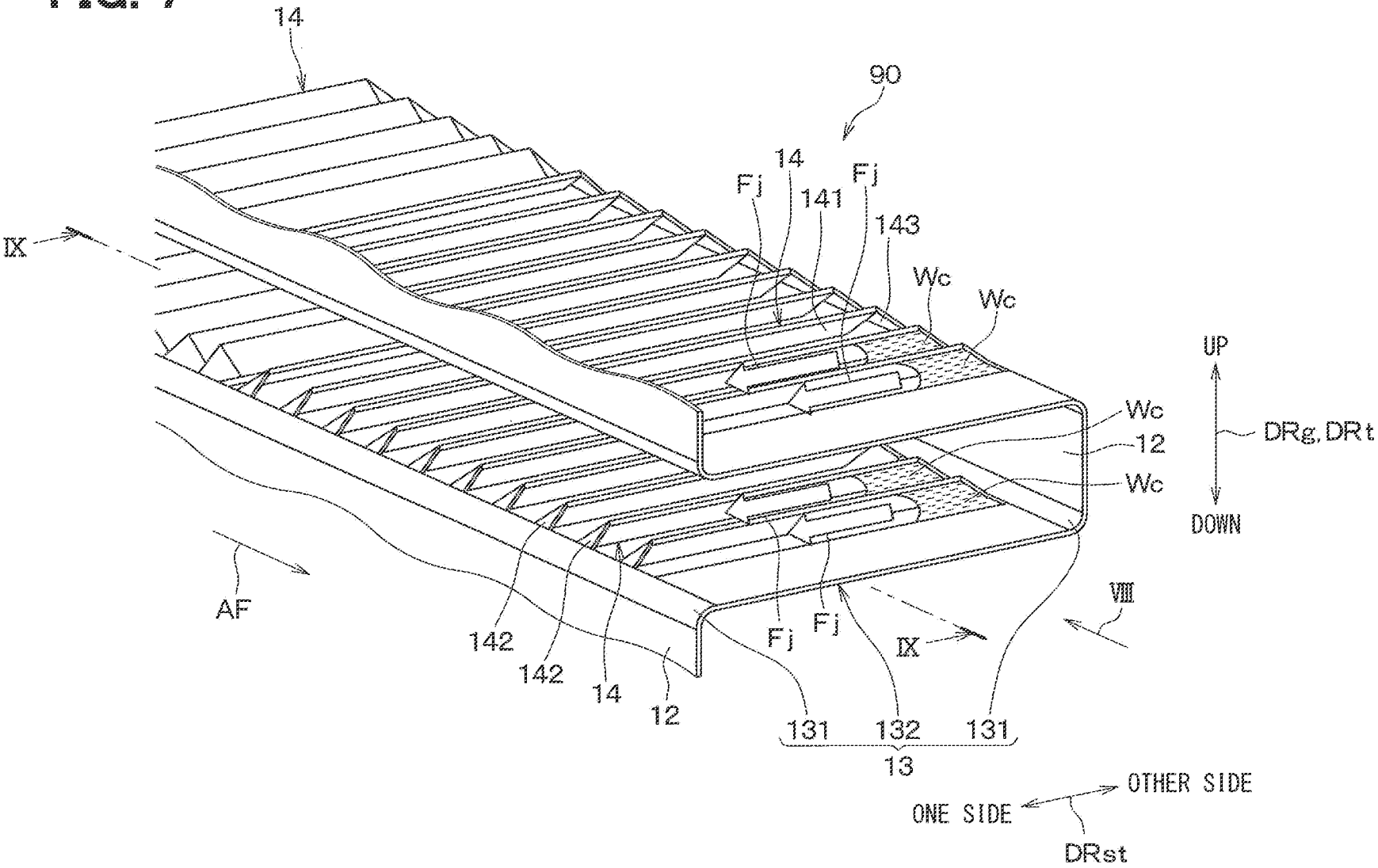
FIG. 7 is a perspective view illustrating in isolation a part of a corrugated fin of a heat exchanger and a first state in which drainage of condensed water is stagnant, according to a comparative example.

Next, in order to describe the effect of the heat exchanger 1 of the present embodiment, a comparative example to be compared with the present embodiment will be described. As illustrated in FIG. 7, a heat exchanger of the comparative example is not provided with the hydrophilic recesses and projections 12*a* to 15*a* on the surface of a corrugated fin 90. That is, the corrugated fin 90 of the comparative example is the same as the corrugated fin 10 of the present embodiment except for having a smooth surface without the hydrophilic recesses and projections 12*a* to 15*a*. Moreover, the components (for example, the tubes 20 and the like) other than the corrugated fin 90 included in the heat exchanger of the comparative example are the same as those of the heat exchanger 1 of the present embodiment.

Figure 8:
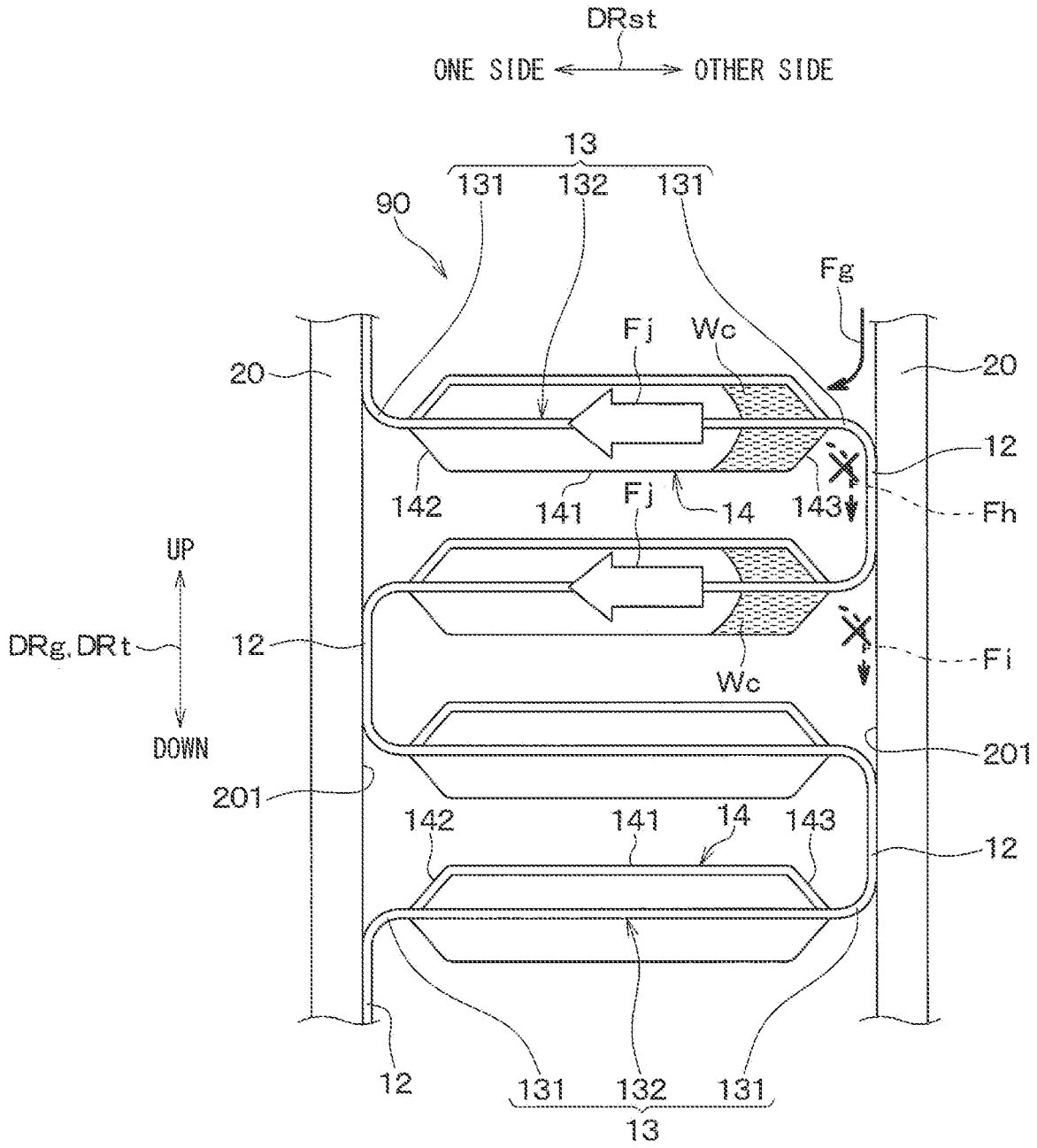
FIG. 8 is a view corresponding to FIG. 4, illustrating the first state in which drainage of condensed water is stagnant as in FIG. 7.

In the corrugated fin 90 of the comparative example illustrated in FIGS. 7 and 8, each louver 14 exhibits high heat exchange performance between air and the refrigerant so that a large amount of condensed water is generated. The condensed water being generated is led to the one louver end 142 or the other louver end 143 forming a narrow gap. In addition, the condensed water flowing from the upper side along the joint 12 or the tube wall surface 201 is also led to the one louver end 142 or the other louver end 143. For example, in FIG. 8, the flow of the condensed water led to the other louver end 143 from the upper side is indicated by arrow Fg.

In the corrugated fin 90 of the comparative example, the hydrophilicity of the one louver end 142 and the other louver end 143 is lower than that of the present embodiment, so that drainage from the one louver end 142 or the other louver end 143 to the joint 12 or the tube wall surface 201 is more likely to be stagnant. For example, when drainage from the other louver end 143 to the joint 12 or the tube wall surface 201 becomes stagnant as indicated by arrows Fh and Fi in FIG. 8, the condensed water We stagnates in the gap between the louvers 14. The stagnant condensed water Wc spreads throughout the gap between the louvers 14 as indicated by arrow Fj, whereby the entire gap between the louvers 14 is clogged.

Figure 9:
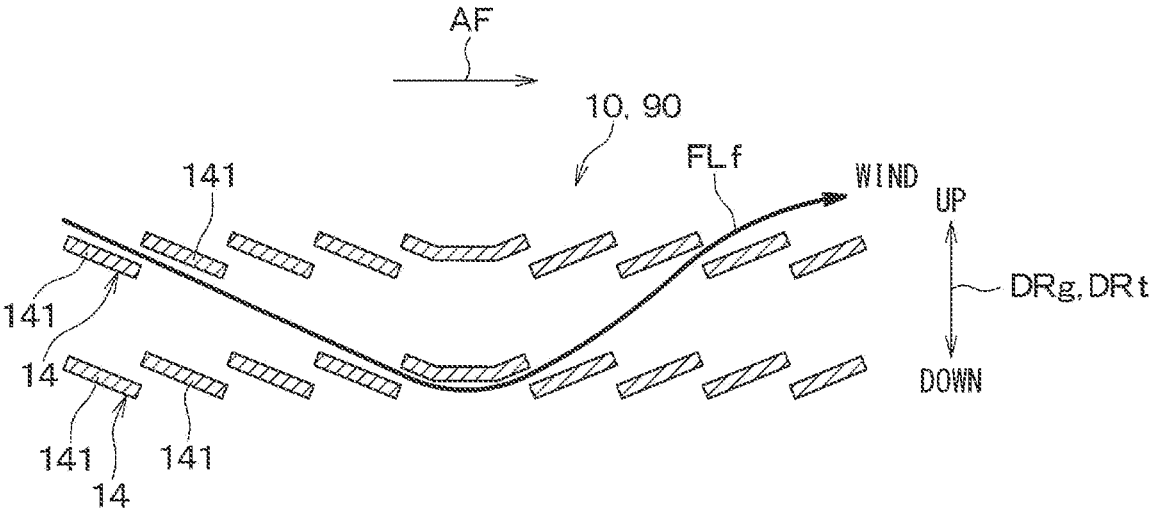
FIG. 9 is a cross-sectional view illustrating an air flow in the absence of condensed water in a corrugated fin having a louver.
Figure 10:
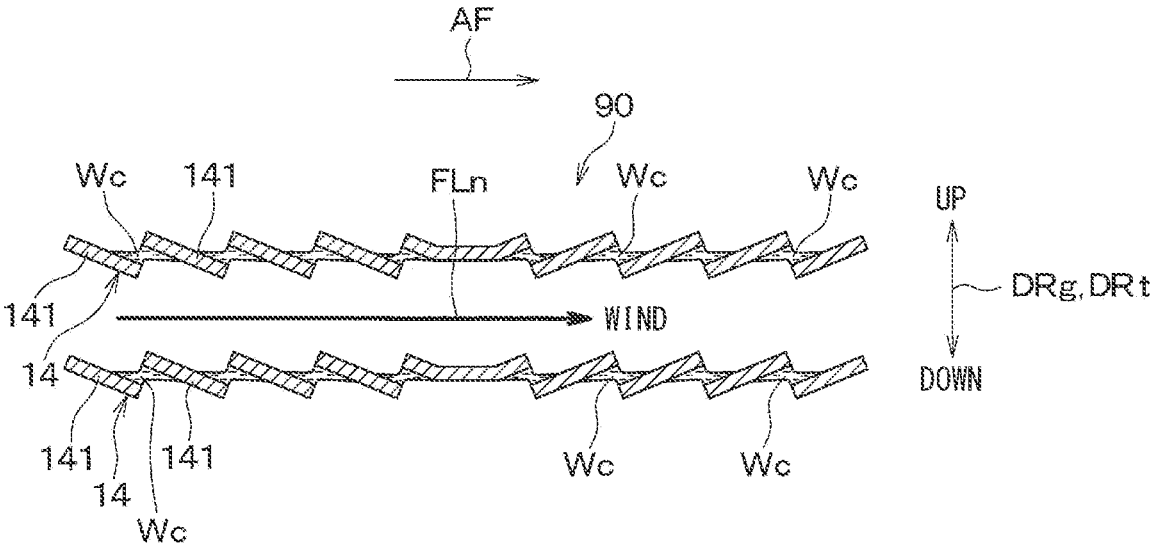
FIG. 10 is a cross-sectional view illustrating an air flow when drainage of condensed water is stagnant as in FIGS. 7 and 8 in a corrugated fin of a comparative example.

If there is no condensed water Wc between the louvers 14, for example, the air meanders along the louvers 14 as indicated by arrow FLf in FIG. 9. However, when the gap between the louvers 14 is clogged with the condensed water We as described above, the louvers 14 fail to function and cause the air to flow linearly as indicated by arrow FLn in FIG. 10. Thus, when the gap between the louvers 14 is clogged with the condensed water Wc, the meandering flow of the air as indicated by arrow FLf in FIG. 9 is not maintained so that the cooling performance is reduced.

Figure 11:
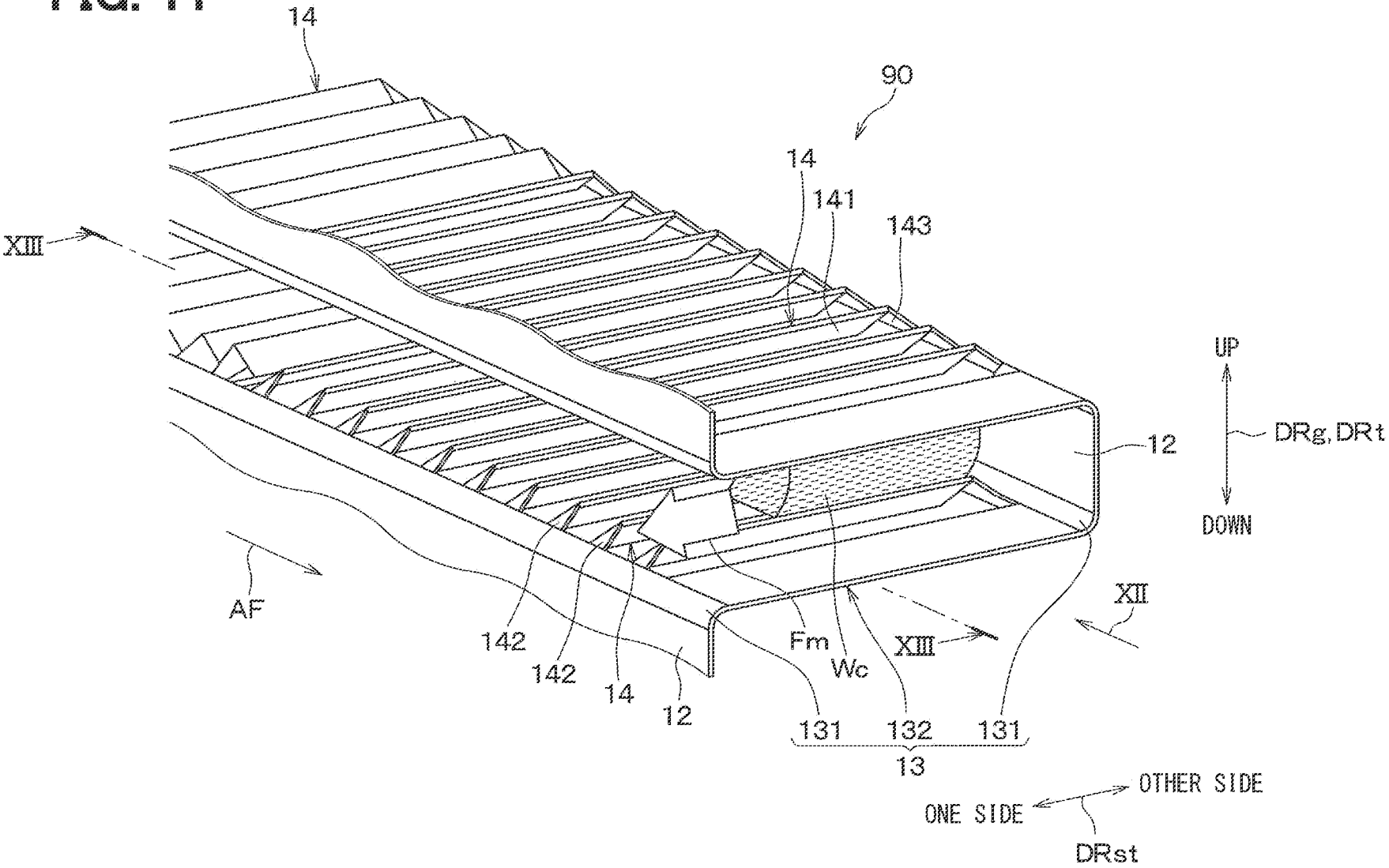
FIG. 11 is a perspective view illustrating in isolation a part of the corrugated fin of the heat exchanger and a second state in which drainage of condensed water is stagnant, according to the same comparative example as that of FIG. 7.
Figure 12:
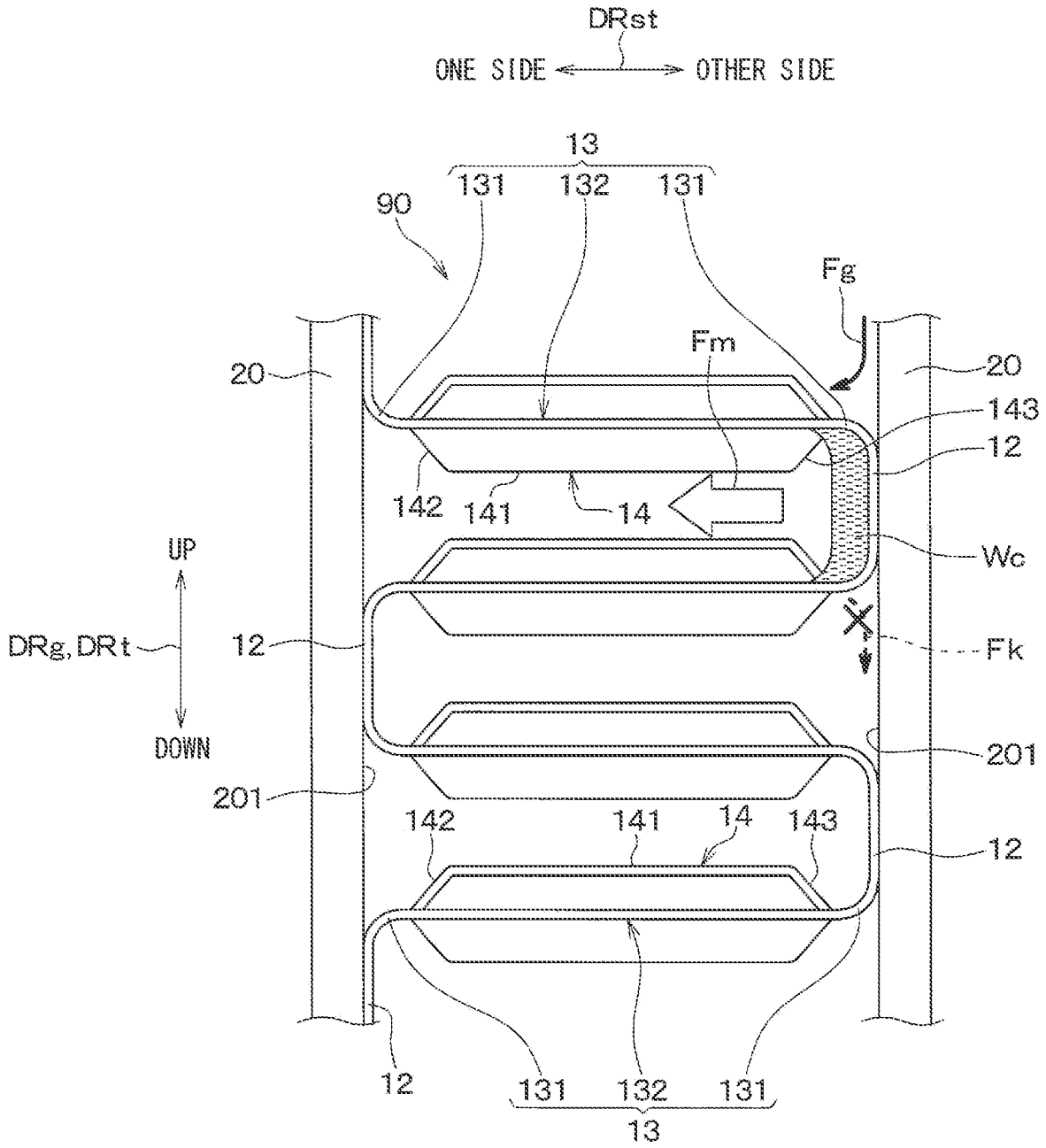
FIG. 12 is a view corresponding to FIG. 4, illustrating the second state in which drainage of condensed water is stagnant as in FIG. 11.

Moreover, in the corrugated fin 90 of the comparative example, as illustrated in FIGS. 11 and 12, drainage from the joint 12 of the corrugated fin 90 to the tube wall surface 201 located under the joint 12 tends to become stagnant. For example, when drainage from the joint 12 to the tube wall surface 201 via the other louver end 143 becomes stagnant as indicated by arrow Fk in FIG. 12, the condensed water Wc stagnates between the fin bodies 13 arranged in the tube extending direction DRt. Then, the condensed water Wc flowing from the upper side as indicated by arrow Fg and the condensed water Wc generated in the louver 14 join the stagnant condensed water Wc. Accordingly, the condensed water Wc stagnant between the fin bodies 13 spreads over the entire width in the tube arrangement direction DRst in the gap between the fin bodies 13 as indicated by arrow Fm. As a result, the gap between the fin bodies 13 is closed by the condensed water Wc.

Figure 13:
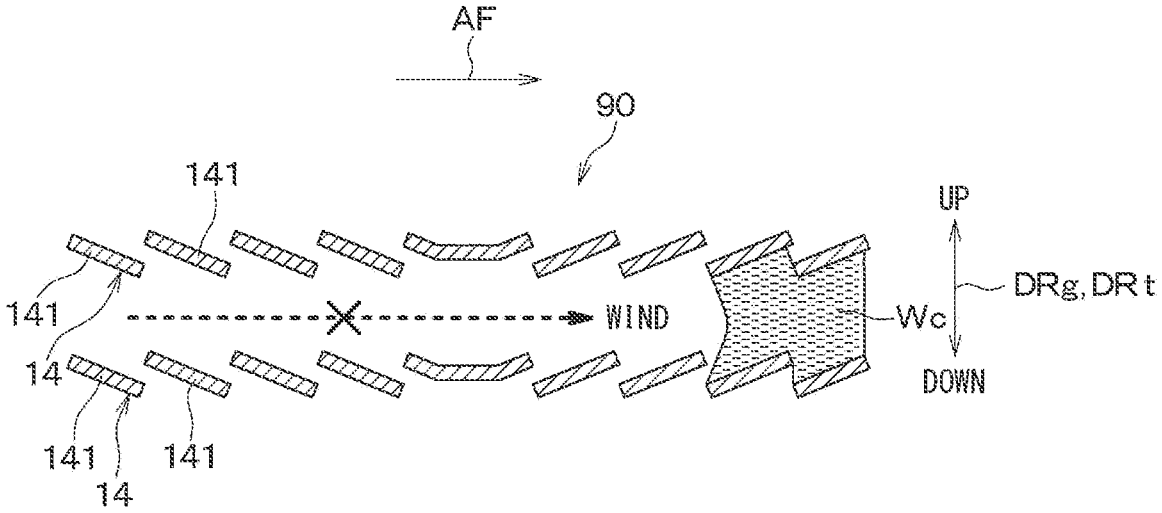
FIG. 13 is a cross-sectional view illustrating an air flow when drainage of condensed water is stagnant as in FIGS. 11 and 12 in a corrugated fin of a comparative example.

When the gap between the fin bodies 13 is closed by the condensed water Wc as described above, the air is held back at the site where the gap between the fin bodies 13 is closed as illustrated in FIG. 13. When the gap between the fin bodies 13 is closed by the condensed water Wc at several sites of the heat exchanger of the comparative example, the air flow resistance through the heat exchanger is increased accordingly to cause a decrease in the performance of the heat exchanger.

On the other hand, the heat exchanger 1 of the present embodiment is configured to prevent the stagnation of the condensed water Wc (in other words, the stagnation of drainage) that can occur in the heat exchanger of the comparative example described with reference to FIGS. 7 to 13. The present embodiment prevents the stagnation of the condensed water Wc, that is, improves the drainage of the condensed water Wc, to be able to reduce the air flow resistance of heat exchanger 1 and improve the performance of the heat exchanger 1.

For example, as illustrated in FIG. 3, the one louver end 142 of the present embodiment has the hydrophilic recesses and projections 142*a*, which is formed to increase the hydrophilicity of the surface of the one louver end 142, on each of both sides in the thickness direction of the one louver end 142. The other louver end 143 has the hydrophilic recesses and projections 143*a*, which is formed to increase the hydrophilicity of the surface of the other louver end 143, on each of both sides in the thickness direction of the other louver end 143.

The hydrophilicity of the surfaces of the one louver end 142 and the other louver end 143 is high as described above, whereby the condensed water adhering to the louver 14 is less likely to be stagnant at each of the one louver end 142 and the other louver end 143. The condensed water is thus quickly drained to the joint 12 or the tube wall surface 201 of the corrugated fin 10. That is, the drainage through the one louver end 142 and the other louver end 143 being a part of the drainage path can be promoted.

It is therefore possible to prevent the condensed water from stagnating in the louvers 14 of the corrugated fin 10. As a result, for example, the function of the louvers 14 for guiding the air as indicated by arrow FLf in FIGS. 2 and 9 is not hindered by the condensed water adhering to the louvers 14.

The groove 142*b* as the recess of the hydrophilic recesses and projections 142*a* of the one louver end 142 has a force of pulling the condensed water, whereby the drainage of the condensed water flowing through the one louver end 142 can be promoted using the force of the groove 142*b* pulling the condensed water. The similar is true for the other louver end 143. It is therefore easier to prevent the stagnation of the condensed water in the louvers 14 as compared with the configuration in which only one of the one louver end 142 and the other louver end 143 has the hydrophilic recesses and projections 142*a* or 143*a*.

Figure 14:
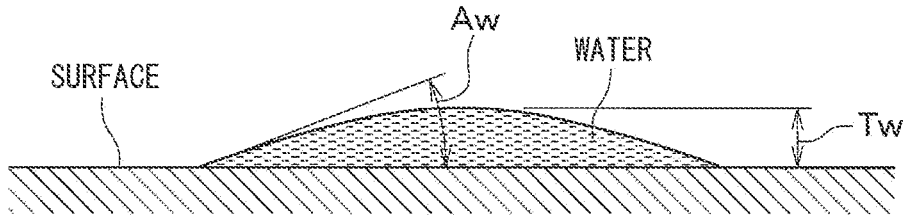
FIG. 14 is a schematic view illustrating a film thickness and an angle of contact of water adhering to the surface of an object such as a corrugated fin.

The hydrophilicity of the surface of the corrugated fin 10 can be improved by providing the recesses and projections on the surface as described above, and specific effects obtained by the improvement of the hydrophilicity are as follows. That is, the improvement of the hydrophilicity of the surface can increase the extent of wetting and spreading of water adhering to the surface. Then, as illustrated in FIG. 14, a film thickness Tw and an angle of contact Aw of the water can be reduced. Such an effect promotes the drainage of the condensed water in the heat exchanger 1 of the present embodiment.

According to the present embodiment, as illustrated in FIGS. 3 and 5, the one louver end 142 has the hydrophilic recesses and projections 142*a* of the one louver end 142 on each of both sides in the thickness direction of the one louver end 142. Thus, as compared with the case where the hydrophilic recesses and projections 142*a* is provided only on one side in the thickness direction of the one louver end 142, a greater effect of preventing the stagnation of the condensed water in the louvers 14 can be obtained. The similar is true for the other louver end 143.

According to the present embodiment, as illustrated in FIGS. 3 and 4, the fin body 13 has the pair of curved connections 131 curved and connected to the joints 12 at both ends of the fin body 13 in the tube arrangement direction DRst. The pair of curved connections 131 each has the hydrophilic recesses and projections 131*a* formed to increase the hydrophilicity of the surface of the curved connection 131 on each of both sides in the thickness direction of the curved connection 131. Thus, the high hydrophilicity of the surface of the curved connection 131 can promote the drainage from the curved connection 131 to the joint 12 or the tube wall surface 201.

According to the present embodiment, the hydrophilic recesses and projections 142*a* of the one louver end 142 includes the plurality of grooves 142*b*. The hydrophilic recesses and projections 131*a* of one curved connection 131 of the pair of curved connections 131 closer to the one louver end 142 also includes the plurality of grooves 131*b*. At least any of the plurality of grooves 142*b* of the one louver end 142 is connected to at least any of the plurality of grooves 131*b* of the one curved connection 131.

Figure 15:
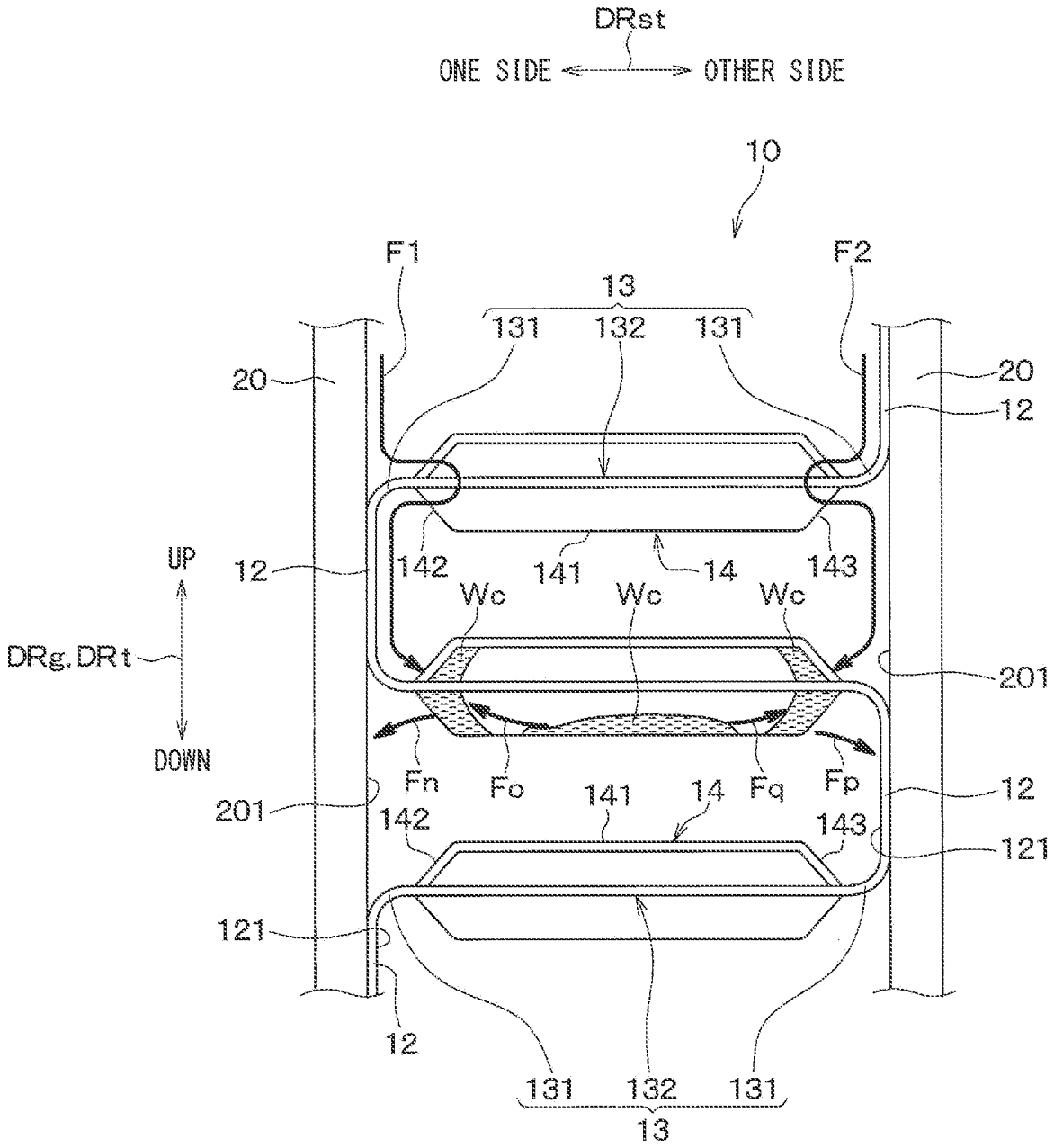
FIG. 15 is a view corresponding to FIG. 4, illustrating a phenomenon in which condensed water is drained from a louver in at least one embodiment.

As a result, the condensed water adhering to the one louver end 142 is more easily pulled to the one curved connection 131, so that the drainage from the louver 14 can be promoted. Thus, the drainage from the louver 14 to the joint 12 or the tube wall surface 201 via the one curved connection 131 can be promoted. For example, the drainage of the condensed water Wc flowing as indicated by arrows Fn and Fo in FIGS. 6 and 15 can be promoted.

The drainage from the louver 14 is promoted in a similar manner at the other louver end 143 as well. That is, the present embodiment can promote the drainage of the condensed water We flowing through the other louver end 143 as indicated by arrows Fp and Fq in FIG. 15, for example.

According to the present embodiment, as illustrated in FIGS. 3 and 4, the joint 12 has the hydrophilic recesses and projections 12*a*, which is formed to increase the hydrophilicity of the surface of the joint 12, on the side opposite to the side joined to the tube 20. Therefore, the drainage of the condensed water is less likely to be stagnant at the joint 12, whereby the drainage from the one louver end 142 or the other louver end 143 to the joint 12 can be promoted.

Moreover, the plurality of grooves 12*b* included in the hydrophilic recesses and projections 12*a* of the joint 12 pulls the condensed water from the curved connection 131 connected on the upper side of the joint 12. Such a configuration can also promote the drainage of the condensed water We flowing as indicated by arrow Fr in FIG. 16, for example.

Figure 16:
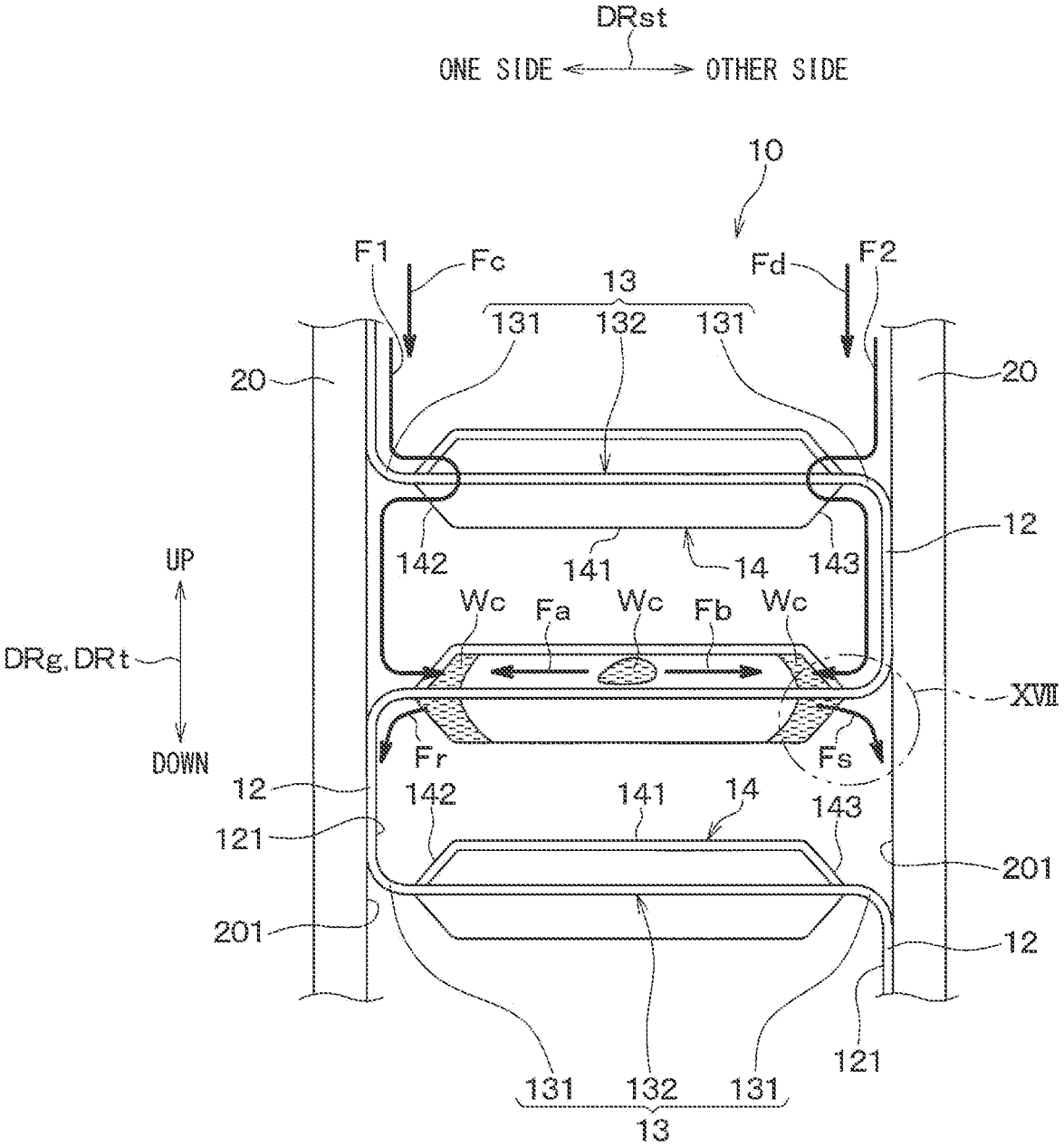
FIG. 16 is a view corresponding to FIG. 4, illustrating a phenomenon in which condensed water is drained from a curved connection of a fin body to a joint or a tube wall surface in at least one embodiment.

In area XVII of FIG. 16, the plurality of grooves 131*b* of the curved connection 131 illustrated in FIG. 3 pulls the condensed water Wc on the surface. At the same time, since the convex side of the curved shape of the curved connection 131 is oriented obliquely downward, the pulling force caused by the curved shape acts on the condensed water Wc on the curved connection 131. Therefore, the drainage of the condensed water Wc flowing from the curved connection 131 to the tube wall surface 201 as indicated by arrows Fs and Ft in FIGS. 16 and 17 can be promoted.

Figure 18:
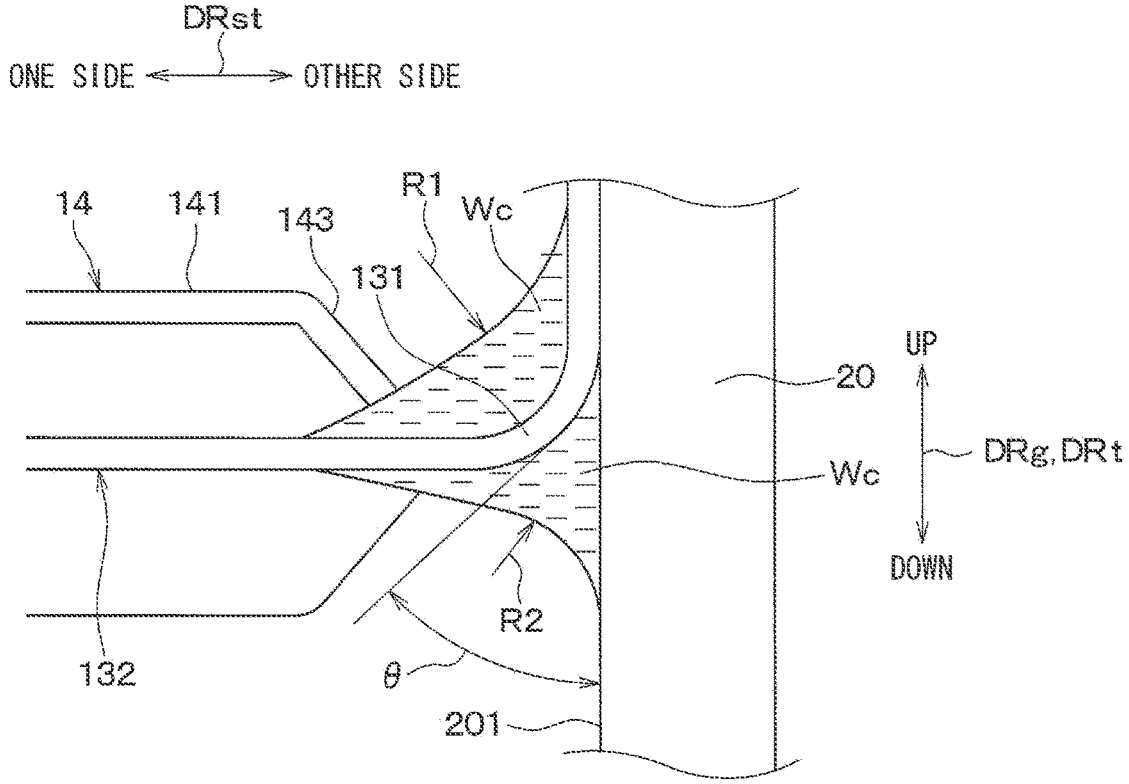
FIG. 18 is a second enlarged detail view of area XVII in FIG. 16.

FIG. 18 illustrates a view for describing the pulling of the condensed water Wc caused by the curved shape of the curved connection 131. As illustrated in FIG. 18, a radius of curvature R1 of the surface of the condensed water Wc adhering to the concave side of the curved shape of the curved connection 131 is larger than a radius of curvature R2 of the surface of the condensed water Wc adhering to the convex side of the curved shape. This is because an angle θ between the surface on the convex side of the curved shape of the curved connection 131 and the tube wall surface 201 is an acute angle. When water accumulates in a corner as a physical phenomenon, the radius of curvature of the surface of the water is smaller as the angle formed by two sides forming the corner is smaller.

Figure 17:
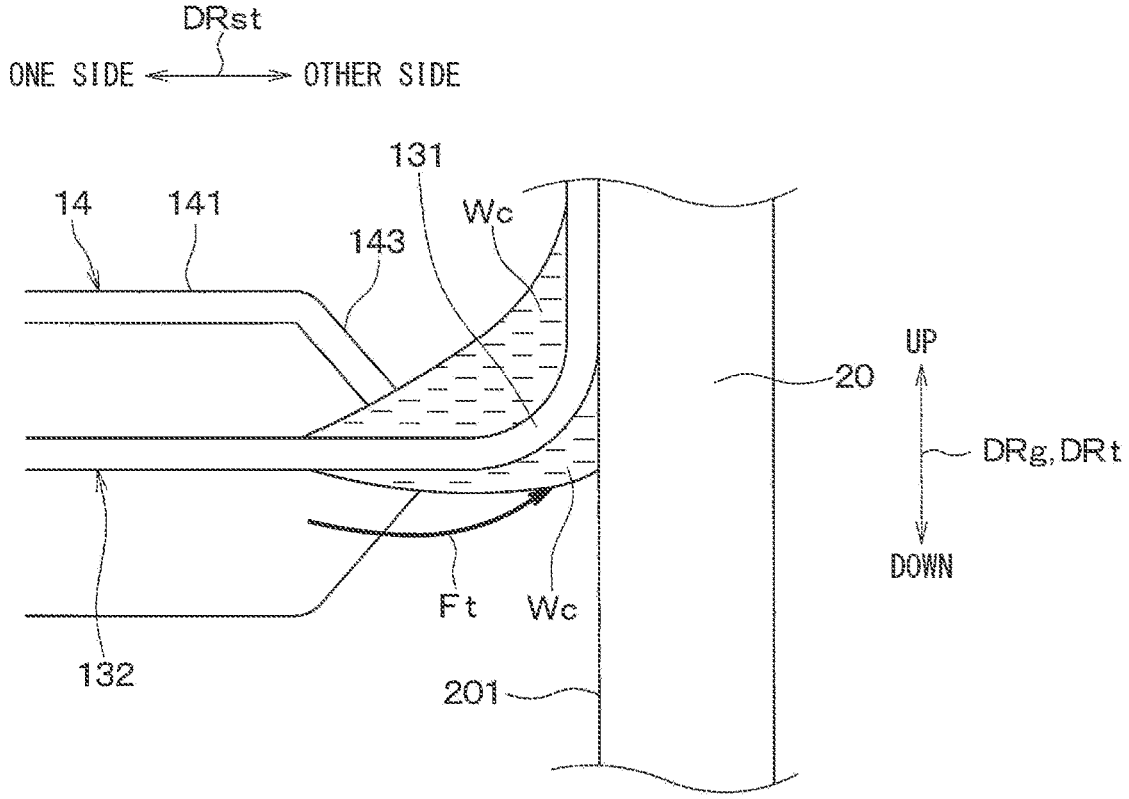
FIG. 17 is a first enlarged detail view of area XVII in FIG. 16.

From such a relationship in magnitude between the radii of curvature R1 and R2, the force of pulling the condensed water Wc is larger on the convex side than on the concave side of the curved shape of the curved connection 131, whereby the drainage flow as indicated by arrows Fs and Ft in FIGS. 16 and 17 is promoted.

According to the present embodiment, as illustrated in FIG. 3, the louver body portion 141 has the hydrophilic recesses and projections 141*a*, which is formed to increase the hydrophilicity of the surface of the louver body portion 141, on each of both sides in the thickness direction of the louver body portion 141. Thus, as indicated by arrows Fa and Fb in FIG. 4, the wetting and spreading of the condensed water We is promoted on the surface of the louver body portion 141. As a result, the condensed water Wc flows easily from the louver body portion 141 to each of the one louver end 142 and the other louver end 143, and the drainage from the louver 14 can be improved.

According to the present embodiment, as illustrated in FIG. 3, the flat surface 15 of the corrugated fin 10 has the plurality of first flat surface grooves 15*b* and the plurality of second flat surface grooves 15*c* formed to increase the hydrophilicity of the flat surface 15. The plurality of first flat surface grooves 15*b* extends to intersect the plurality of second flat surface grooves 15*c*.

Figure 19:
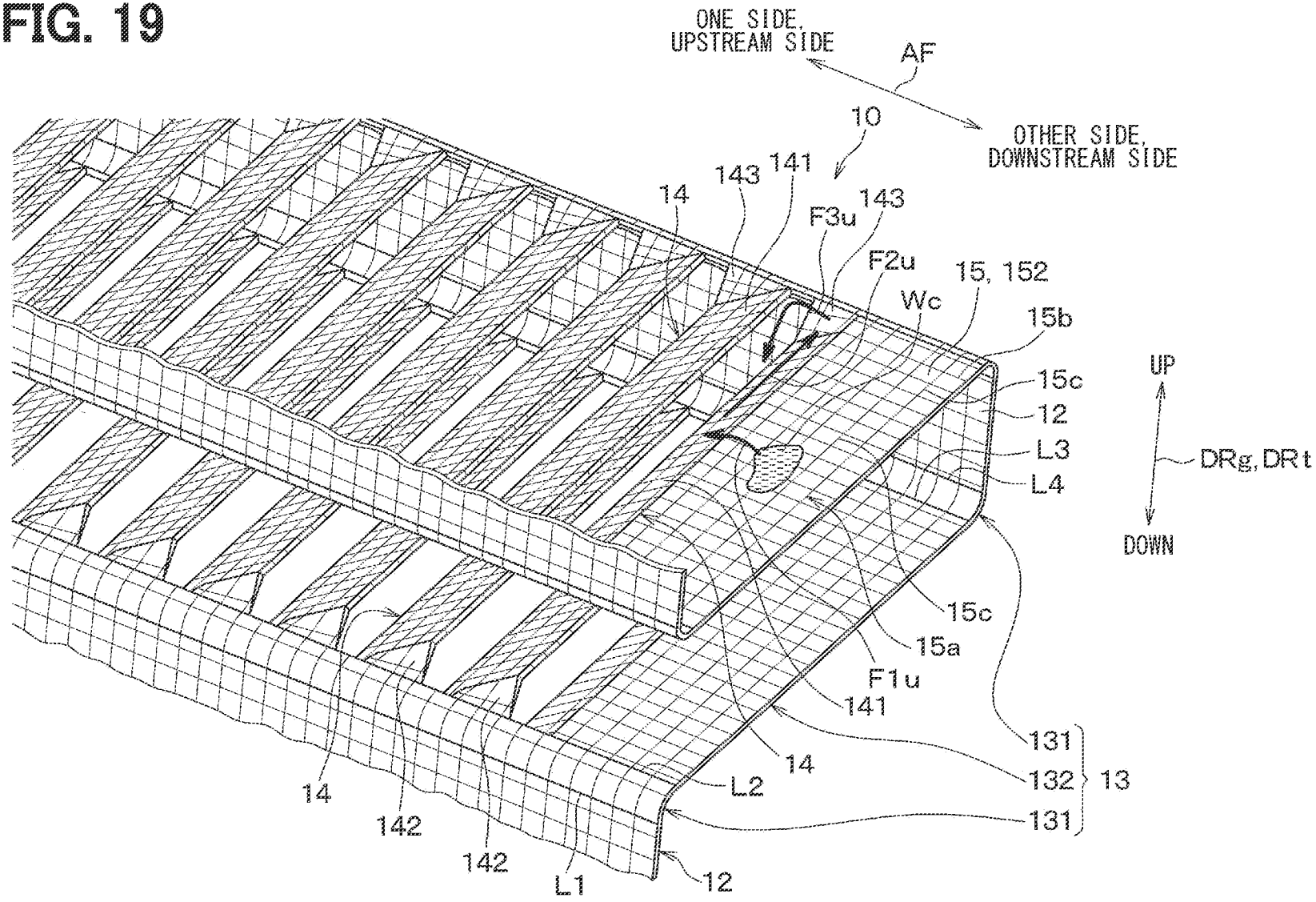
FIG. 19 is a perspective view corresponding to FIG. 3, illustrating a drainage path through which condensed water is drained from a flat surface of the corrugated fin in at least one embodiment.

Accordingly, the condensed water We adhering on the flat surface 15 wets and spreads while being pulled by the first flat surface grooves 15*b* and the second flat surface grooves 15*c*, and is drained to the area around the flat surface 15. For example, as indicated by arrows F1*u*, F2*u*, and F3*u* in FIG. 19, the condensed water Wc adhering on the flat surface 15 is drained from the flat surface 15 to the lower side through the gap between the louvers 14. At this time, with the plurality of first flat surface grooves 15*b* and the plurality of second flat surface grooves 15*c* intersecting one another, a wide variety of drainage paths is formed on the flat surface 15 so that the drainage from the flat surface 15 can be improved.

Figure 20:
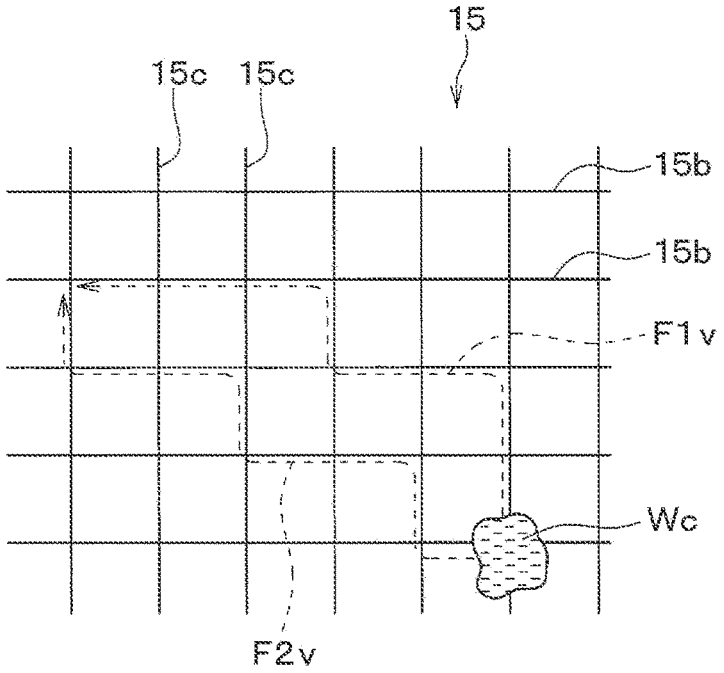
FIG. 20 is a schematic view for explaining the drainage path of condensed water formed on the flat surface in at least one embodiment.

For example, as illustrated in FIG. 20, the plurality of first flat surface grooves 15*b* and the plurality of second flat surface grooves 15*c* intersect one another so that many drainage paths of the condensed water Wc are established on the flat surface 15 each as a path in which parts of the first flat surface grooves 15*b* and parts of the plurality of second flat surface grooves 15*c* are connected. As a result, for example, a path along arrow F1*v* and a path along arrow F2*v* can be the drainage paths of the condensed water Wc. Such a wide variety of drainage paths of the condensed water We can improve the drainage from the flat surface 15.

According to the present embodiment, as illustrated in FIG. 3, the plurality of second flat surface grooves 15*c* is the longitudinal grooves extending in the tube arrangement direction DRst. The second flat surface grooves 15*c* thus pull the condensed water Wc adhering on the flat surface 15 in the tube arrangement direction DRst, so that the condensed water Wc is easily led to the tube 20 adjacent to the corrugated fin 10. Therefore, the drainage from the flat surface 15 can be improved.

According to the present embodiment, in addition to the plurality of second flat surface grooves 15*c*, the plurality of first flat surface grooves 15*b* extending in the air passage direction AF is also provided on the flat surface 15. Thus, the hydrophilicity of the flat surface 15 is also improved by the first flat surface grooves 15*b* so that the drainage from the flat surface 15 can be improved.

According to the present embodiment, as illustrated in FIGS. 1 and 4, the plurality of tubes 20 extends in the perpendicular direction. Therefore, the drainage of the condensed water along the tube wall surface 201 as in arrows F1 and F2 of FIG. 4 can be improved by gravity.

According to the present embodiment, the depth h of the recesses included in the hydrophilic recesses and projections 12*a* to 15*a* illustrated in FIG. 5 is 10 μm or deeper, for example. As a result, the hydrophilicity due to the hydrophilic recesses and projections 12*a* to 15*a* is gained sufficiently, and the drainage effect of draining the condensed water adhering to the surface with the hydrophilic recesses and projections 12*a* to 15*a* can be sufficiently exhibited. When the depth h of the recesses is less than 10 μm, for example, it is difficult to gain sufficient hydrophilicity for achieving satisfactory drainage.

Figure 21:
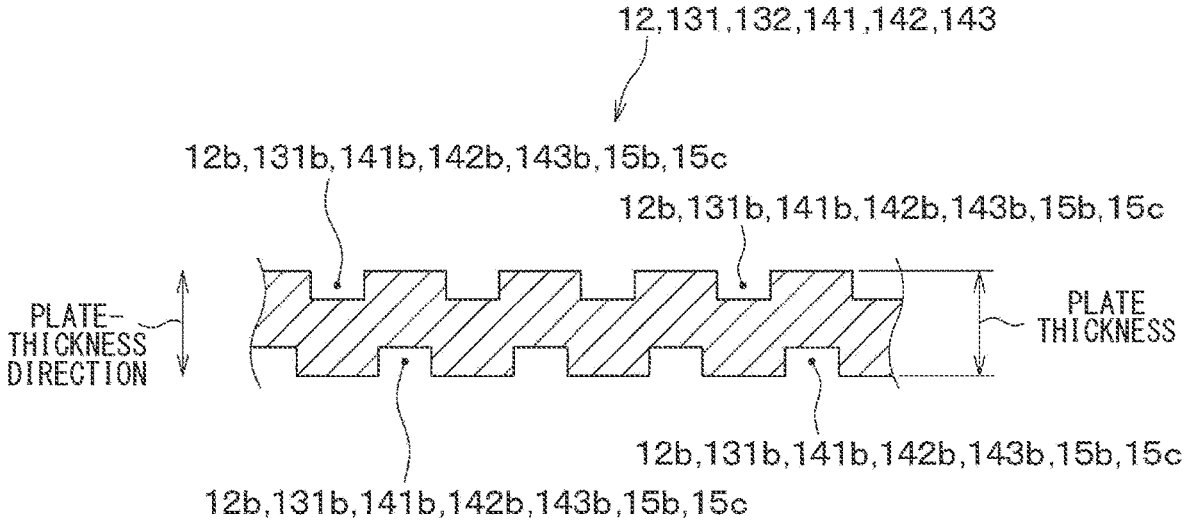
FIG. 21 is a schematic cross-sectional view of an alternating groove part of the corrugated fin of FIG. 2 taken along a plane parallel to the thickness direction of the corrugated fin.

In the present embodiment, among the plurality of grooves 12*b* to 15*c*, one surface grooves provided on the surface at one side in the thickness direction and other surface grooves provided on the surface at the other side are in an alternate arrangement in a part of the corrugated fin 10, as illustrated in area B1 of FIG. 5 and FIG. 21. The alternate arrangement means that the one surface grooves and the other surface grooves are alternately arranged in the direction along the surface on the one side or the other side in the thickness direction. In other words, in the alternate arrangement, the one surface grooves are arranged in the same direction as the other surface grooves and arranged so as not to overlap with the other surface grooves on the one side in the thickness direction.

The part of the corrugated fin 10 where the plurality of grooves 12*b* to 15*c* is in the alternate arrangement as described above can avoid a local reduction in thickness of the corrugated fin 10 caused by formation of the grooves 12*b* to 15*c* on the surfaces at both sides in the thickness direction. Therefore, the part with the alternate arrangement can avoid a decrease in strength of the corrugated fin 10 caused by the formation of the grooves 12*b* to 15*c*. The part in which the plurality of grooves 12*b* to 15*c* is in the alternate arrangement, that is, an alternating groove part, may be included in any of the components of the corrugated fin 10 such as the joint 12, the fin body 13, or the louver 14, for example.

In the present embodiment, the hydrophilic recesses and projections 12*a* to 15*a* are provided on the surface of the corrugated fin 10 as described above, whereby the hydrophilicity is improved by the shape of the surface. Such a shape of the surface undergoes a small change over time. Therefore, deterioration in the hydrophilicity due to aging does not progress easily so that the hydrophilicity of the surface of the corrugated fin 10 can be stably exhibited.

Figure 22:
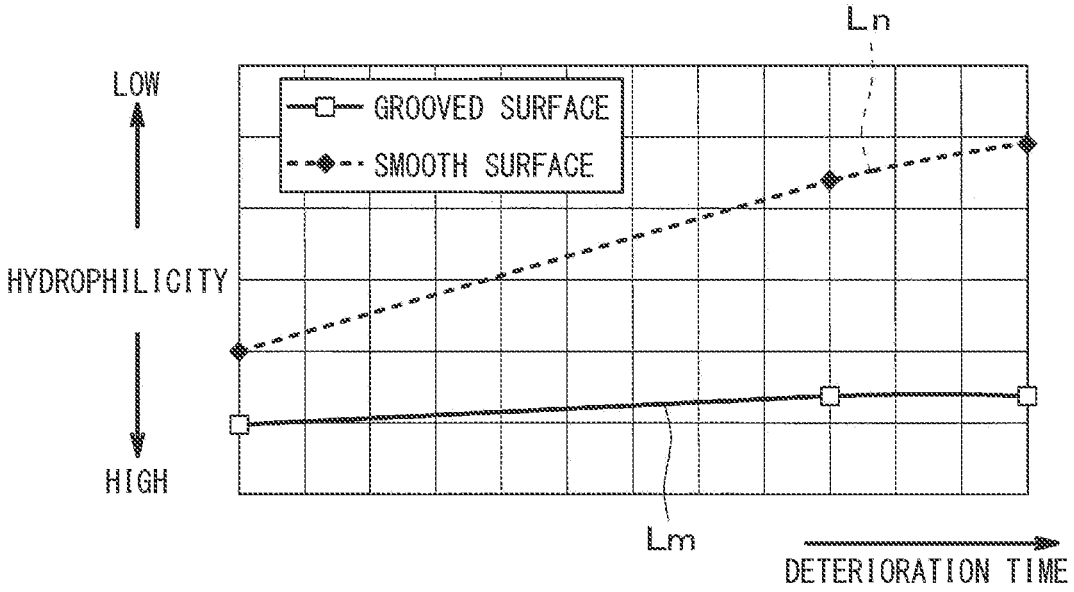
FIG. 22 is a graph illustrating a result of an experiment in which deterioration in hydrophilicity over time is compared between a grooved surface and a smooth surface.

For example, FIG. 22 illustrates a result of an experiment which confirms that the hydrophilicity due to the hydrophilic recesses and projections 12*a* to 15*a* does not easily deteriorate with age. In the experiment illustrated in FIG. 22, a hydrophilic coating is applied to each of a grooved surface on which grooves corresponding to the hydrophilic recesses and projections 12*a* to 15*a* are formed and a smooth surface without the recesses and projections, and a degree of deterioration in hydrophilicity over time is measured for each of the surfaces. The higher the hydrophilicity of the surface, the smaller the angle of contact Aw (see FIG. 14) of water adhering to the surface, for example, so that the hydrophilicity of the grooved surface and the smooth surface can be measured by measuring the angle of contact Aw of water adhering to each surface. FIG. 22 indicates a change in the hydrophilicity of the grooved surface by a solid line Lm, and a change in the hydrophilicity of the smooth surface by a broken line Ln. From the result of the experiment illustrated in FIG. 22, it can be said that the hydrophilicity of the grooved surface is less likely to deteriorate with age as compared to the smooth surface.

In the present embodiment, a chemical method such as applying a hydrophilic coating to the surface of the corrugated fin 10 is not performed and is not essential. However, the effect of improving the hydrophilicity is further increased by combining the provision of the hydrophilic recesses and projections 12*a* to 15*a* with the chemical method.

Next, a second embodiment will be described. The present embodiment will mainly describe points that are different from the first embodiment. In addition, descriptions of parts identical or equivalent to those of the above embodiment will be omitted or simplified. This also applies to the description of third and subsequent embodiments to be described below.

Figure 23:
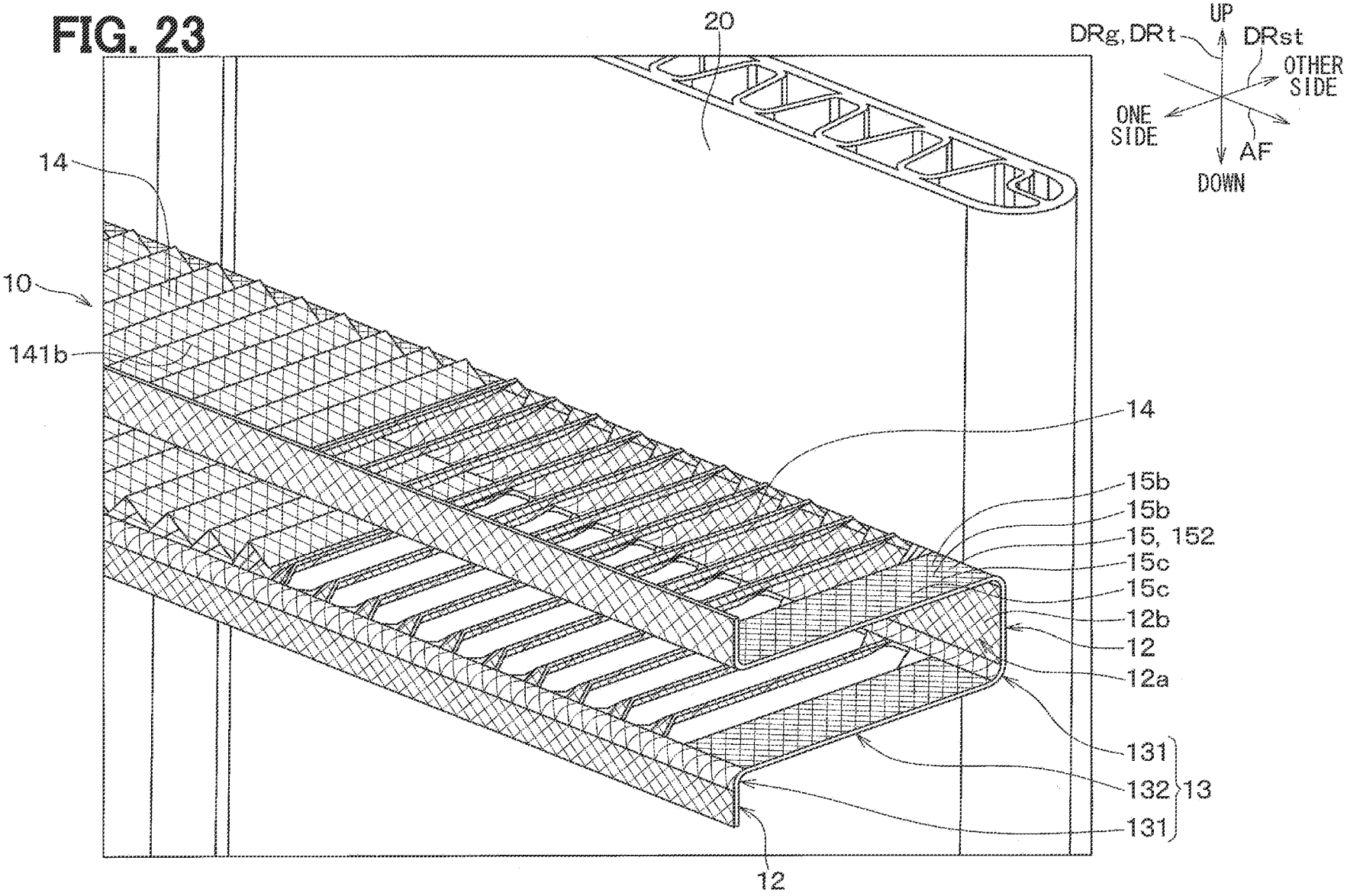
FIG. 23 is an enlarged perspective view of a part of a tube and a corrugated fin included in a heat exchanger in at least one embodiment.

As illustrated in FIG. 23, in the present embodiment, the orientations of the plurality of grooves 12*b* to 15*c* provided on the surface of the corrugated fin 10 are different from those in the first embodiment. Specifically, as illustrated in FIG. 3, most of the grooves 12*b* to 15*c* of the first embodiment described above extend in the direction along or perpendicular to the air passage direction AF. On the other hand, as illustrated in FIG. 23, most of the grooves 12*b* to 15*c* of the present embodiment extend in a direction at an angle with respect to the air passage direction AF.

The present embodiment is similar to the first embodiment except for what is described above. The present embodiment can thus obtain effects similar to those of the first embodiment by the configuration common to the first embodiment.

Next, a third embodiment will be described. The present embodiment will mainly describe points that are different from the first embodiment.

Figure 24:
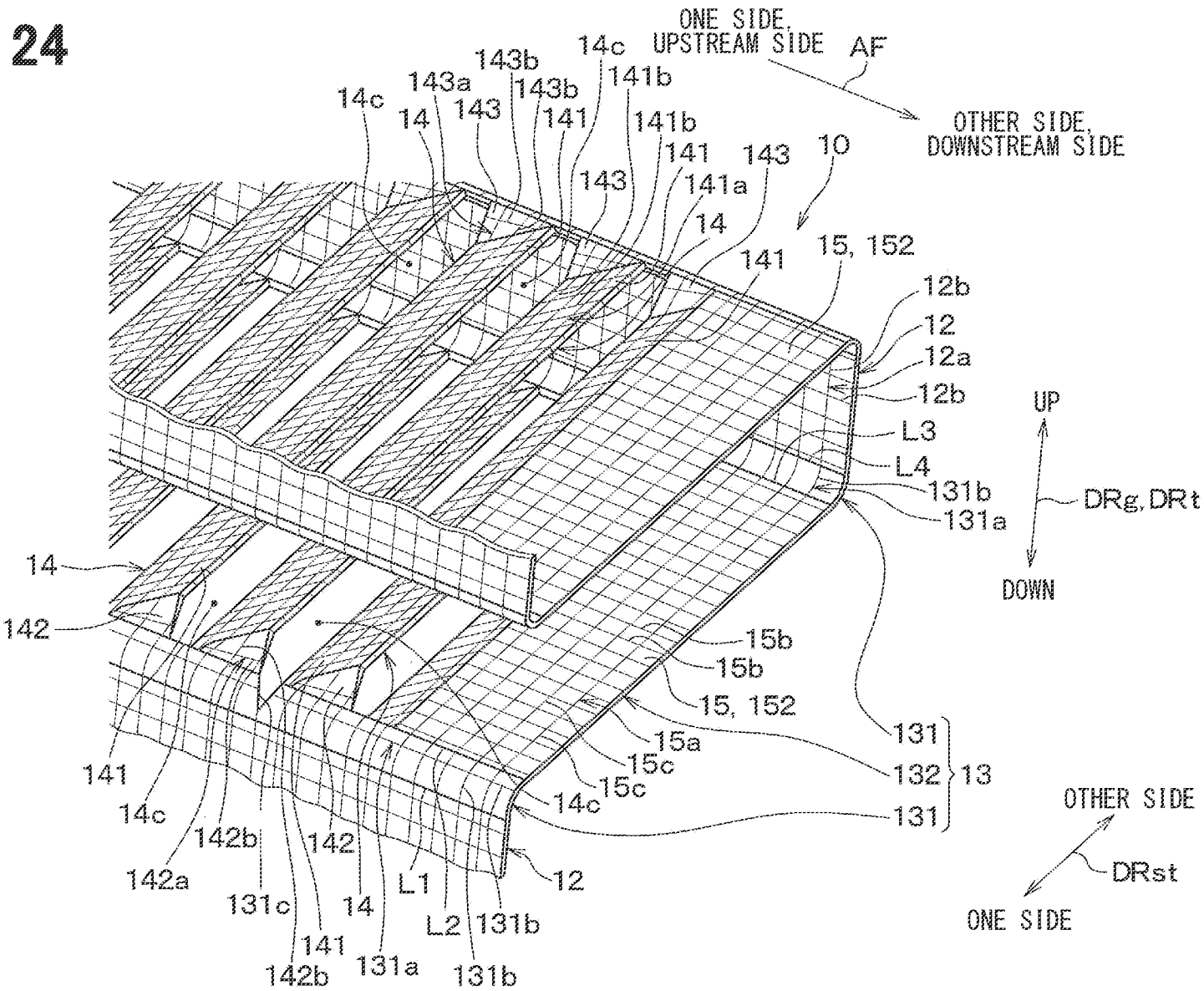
FIG. 24 is an enlarged perspective view corresponding to FIG. 3 of a part of a corrugated fin extracted in isolation in at least one embodiment.

As illustrated in FIG. 24, in the present embodiment, a louver gap 14*c* formed between the louvers 14 arranged side by side in the air passage direction AF is provided in the fin body 13. The louver gap 14*c* is a cut-raised gap formed by the louver 14 having a cut-raised shape, and is adjacent to the louver 14. Since the louver 14 has the shape extending in the tube arrangement direction DRst, the louver gap 14*c* also has the shape extending in the tube arrangement direction DRst.

The corrugated fin 10 of the present embodiment and the corrugated fin 10 of the first embodiment both have the louvers 14, so that the louver gap 14*c* is provided as described above similarly in the present embodiment and the first embodiment.

However, unlike the first embodiment, a notch 131*c* is formed in the pair of curved connections 131 of the fin body 13 in the present embodiment. The notch 131*c* may be formed in at least one of the pair of curved connections 131 but is formed on each of the pair of curved connections 131 in the present embodiment.

Figure 25:
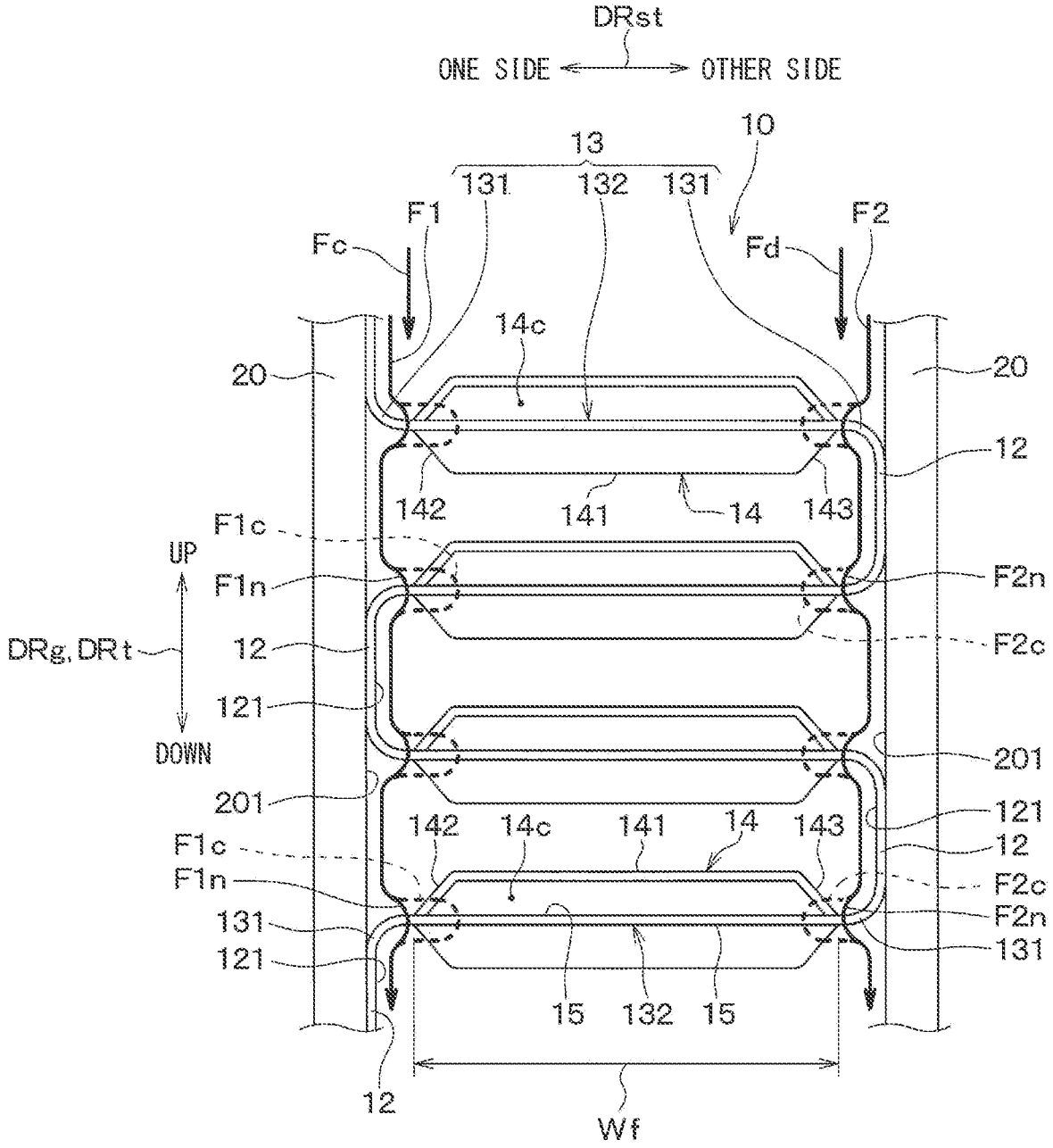
FIG. 25 is a view corresponding to FIG. 4 for explaining a drainage path of condensed water flowing along a tube wall surface in at least one embodiment.

Specifically, the notch 131*c* of each of the curved connections 131 has a shape obtained by cutting each of the curved connections 131 from the louver gap 14*c*. In the present embodiment, the notch 131*c* is provided to correspond to some of a plurality of the louver gaps 14*c* formed in the fin body 13. As illustrated in FIGS. 24 and 25, the notch 131*c* extends outward of a width Wf of the louver 14 in the tube arrangement direction DRst.

Since the notch 131*c* is formed in each of the curved connections 131 as described above, a cut portion in which the notch 131*c* is formed can also be used as the drainage path so that drainage of a region around the cut portion can be performed smoothly.

For example, as illustrated in FIG. 25, the condensed water flows from the upper side to the lower side as indicated by arrows F1 and F2 along the joint 12 and the tube wall surface 201 of the corrugated fin 10 and is drained to the outside of the heat exchanger 1 from the lower part of the heat exchanger 1. At this time, if the notch 131*c* is not formed, the drainage path follows the path of broken lines F1*c* and F2*c* between the louvers 14. On the other hand, in the cut portion where the notch 131*c* is formed in the present embodiment, the drainage path follows the path of solid lines F1*n* and F2*n* through the notches 131*c*. Therefore, the condensed water flowing along the drainage path passing through the notches 131*c* flows down smoothly as compared with the case without the notches 131*c*. As described above, in the present embodiment, the provision of the notches 131*c* enables the condensed water flowing from the upper side to be smoothly drained to the outside of the heat exchanger 1.

The present embodiment is similar to the first embodiment except for what is described above. The present embodiment can thus obtain effects similar to those of the first embodiment by the configuration common to the first embodiment. Although the present embodiment is a modification based on the first embodiment, the present embodiment can be combined with the above second embodiment as well.

Next, a fourth embodiment will be described. The present embodiment will mainly describe points that are different from the first embodiment.

Figure 26:
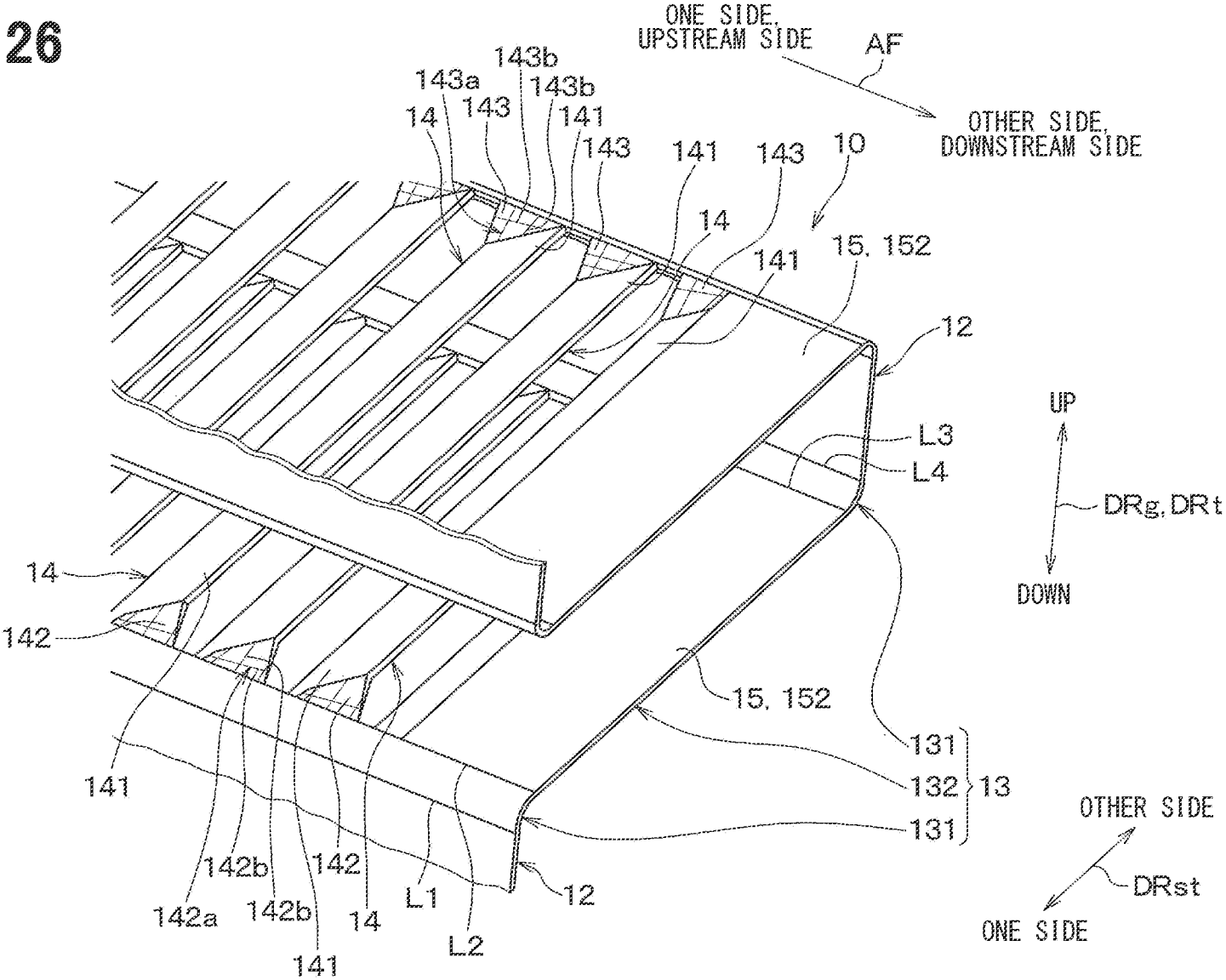
FIG. 26 is an enlarged perspective view corresponding to FIG. 3 of a part of a corrugated fin extracted in isolation in at least one embodiment.

As illustrated in FIG. 26, in the present embodiment, the hydrophilic recesses and projections 142*a* and 143*a* are provided only on the surface of the one louver end 142 and the surface of the other louver end 143 of the entire surface of the corrugated fin 10. The part excluding the one louver end 142 and the other louver end 143 is a smooth surface without the recesses and projections.

The hydrophilic recesses and projections 142*a* and 143*a* of the louver ends 142 and 143 may be formed on at least one side in the thickness direction of the louver ends 142 and 143, but are formed on both sides in the thickness direction of the louver ends 142 and 143 in the present embodiment.

The present embodiment is similar to the first embodiment except for what is described above. The present embodiment can thus obtain effects similar to those of the first embodiment by the configuration common to the first embodiment. Although the present embodiment is a modification based on the first embodiment, the present embodiment can be combined with the above second or third embodiment as well.

Next, a fifth embodiment will be described. The present embodiment will mainly describe points that are different from the first embodiment.

Figure 27:
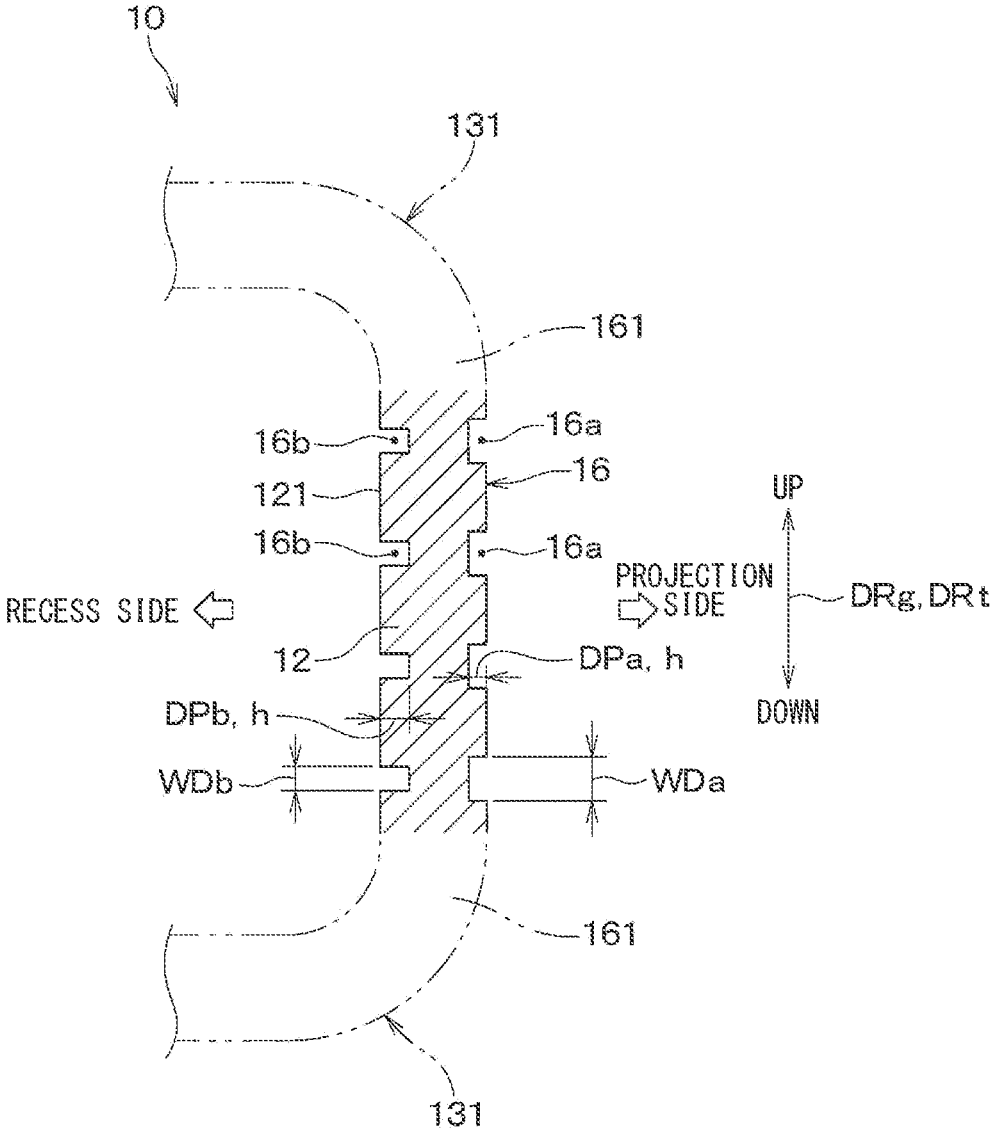
FIG. 27 is a view schematically illustrating a joint and its periphery of a corrugated fin of at least one embodiment in the same direction as FIG. 4, and is a view illustrating a cross section of the joint.

In the present embodiment, as illustrated in FIG. 27, the corrugated fin 10 has tube side ridges 16 that each includes the joint 12 and joint adjacent portions 161 adjacent to the joint 12 of the corrugated fin. The tube side ridge 16 has a curved shape to have a convex surface facing the tube 20 (see FIG. 4) to which the joint 12 of the tube side ridge 16 is joined. Since the tube side ridge 16 includes the joint 12, the corrugated fin 10 has the tube side ridges 16 as many as the joints 12.

The joint adjacent portions 161 form a pair with the joint 12 interposed therebetween, and extend from both ends of the joint 12. Each of the joint adjacent portions 161 is included in each of the curved connections 131. For example, the joint adjacent portions 161 each may be a part or all of each of the curved connections 131.

The tube side ridge 16 has a plurality of hydrophilic grooves 16*a* and 16*b*, which is formed to increase the hydrophilicity of the surface of the tube side ridge 16, on the convex surface joined to the tube 20 and a concave surface on the backside of the convex surface, respectively. That is, the tube side ridge 16 has the plurality of hydrophilic grooves 16*a* provided on the convex surface and the plurality of hydrophilic grooves 16*b* provided on the concave surface. Since the tube side ridge 16 includes the joint 12, the hydrophilic grooves 16*a* and 16*b* of the tube side ridge 16 include the grooves 12*b* (see FIG. 3) of the joint 12. Moreover, the convex surface of the tube side ridge 16 is also called a crest, and the concave surface of the tube side ridge 16 is also called a valley.

The hydrophilic groove 16*a* on the convex surface and the hydrophilic groove 16*b* on the concave surface of the tube side ridge 16 are formed in different shapes. Specifically, a groove depth DPa of the hydrophilic groove 16*a* on the convex surface is smaller than a groove depth DPb of the hydrophilic groove 16*b* on the concave surface. Moreover, a groove width WDa of the hydrophilic groove 16*a* on the convex surface is larger than a groove width WDb of the hydrophilic groove 16*b* on the concave surface.

The above relationship in magnitude between the groove depths DPa and DPb expressed as "DPa<DPb" may hold true for the entire tube side ridge 16 or only a part of the tube side ridge 16. Likewise, the above relationship in magnitude between the groove widths WDa and WDb expressed as "WDa>WDb" may hold true for the entire tube side ridge 16 or only a part of the tube side ridge 16.

The relationships in magnitude between the groove depths DPa and DPb and between the groove widths WDa and WDb in the tube side ridge 16 may or need not extend to a part of the corrugated fin 10 beyond the tube side ridge 16.

The present embodiment is similar to the first embodiment except for what is described above. The present embodiment can thus obtain effects similar to those of the first embodiment by the configuration common to the first embodiment.

According to the present embodiment, among the plurality of hydrophilic grooves 16*a* and 16*b* of the tube side ridge 16, the hydrophilic groove 16*a* on the convex surface has the groove depth DPa smaller than the groove depth DPb of the hydrophilic groove 16*b* on the concave surface.

Accordingly, the hydrophilic grooves 16*a* and 16*b* of the tube side ridge 16 generate the capillary force of "convex surface<concave surface", whereby water is more easily collected on the concave surface of the tube side ridge 16 to be the drainage path. As a result, the water is drained smoothly from the heat exchanger 1. Moreover, the recesses and projections on the surface can be reduced on the convex surface of the tube side ridge 16 joined to the tube 20, whereby the corrugated fin 10 can be reliably joined to the tube 20.

Moreover, in the tube side ridge 16, the groove width WDa of the hydrophilic groove 16*a* on the convex surface is larger than the groove width WDb of the hydrophilic groove 16*b* on the concave surface. In this case as well, water is more easily collected on the concave surface of the tube side ridge 16 as described above, whereby the corrugated fin 10 can be reliably joined to the tube 20.

Although the present embodiment is a modification based on the first embodiment, the present embodiment can be combined with the above second or third embodiment as well.

In each of the embodiments described above, as illustrated in FIG. 5, the groove depth h of the plurality of grooves 12*b* to 15*c* formed on the surface of the corrugated fin 10 is, for example, 10 μm or deeper, which is preferable. However, the groove depth h need not necessarily be 10 μm or deeper.

In each of the embodiments described above, as illustrated in FIG. 3, for example, the grooves 12*b* to 15*c* on the surface of the corrugated fin 10 all extend linearly but may be curved, for example.

The grooves 12*b* to 15*c* may be grooves having uniform or non-uniform groove widths. Moreover, the grooves 12*b* to 15*c* may be grooves having uniform or non-uniform groove depths.

Figure 28:
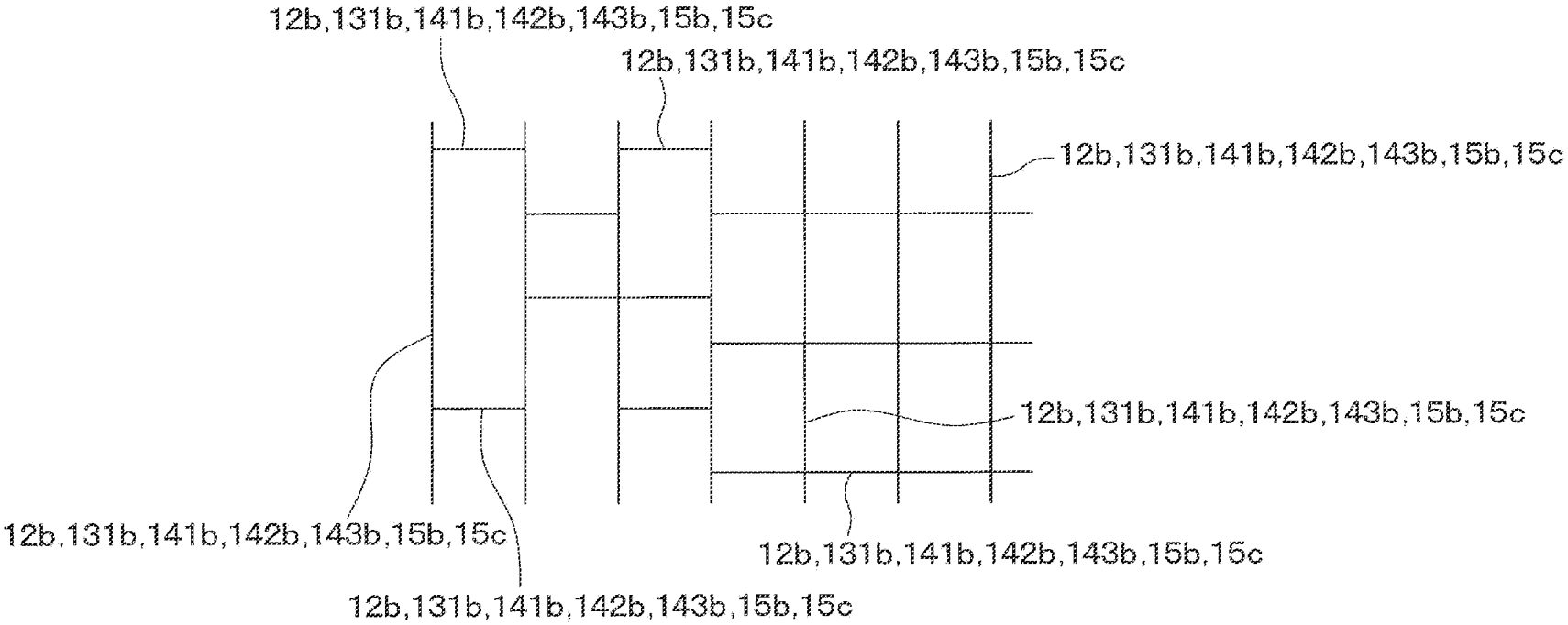
FIG. 28 is a schematic view illustrating a modification of a plurality of grooves provided on the surface of the corrugated fin of each embodiment.

In each of the embodiments described above, as illustrated in FIGS. 3 and 23, the plurality of grooves 12*b* to 15*c* provided on the surface of the corrugated fin 10 each extends continuously from end to end of the surface, which is one example. In another example, as illustrated in FIG. 28, the plurality of grooves 12*b* to 15*c* may each be divided discontinuously.

In each of the embodiments described above, as illustrated in FIGS. 1 and 4, the heat exchanger 1 is disposed such that the tubes 20 extend in the perpendicular direction DRg, but the installation orientation of the heat exchanger 1 is not limited. For example, as illustrated in FIG. 29, the heat exchanger 1 may be disposed such that the tubes 20 extend in the horizontal direction.

Figure 29:
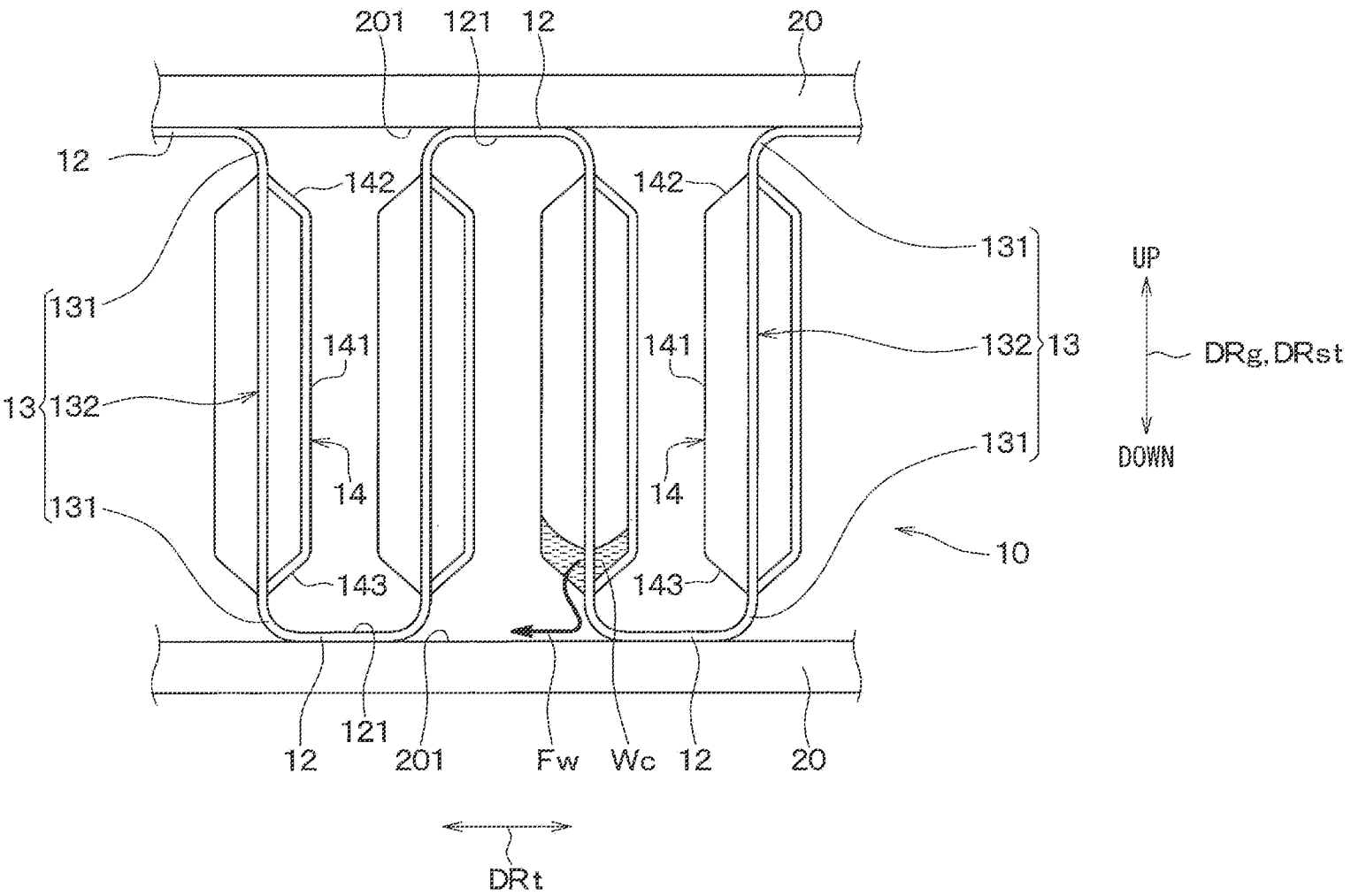
FIG. 29 is a view corresponding to FIG. 4 and illustrating a heat exchanger placed horizontally as a modification of each embodiment.

When the heat exchanger 1 is disposed as illustrated in FIG. 29, the condensed water We flows as indicated by arrow Fw, for example, when drained from the louver 14 to the joint 12 or the tube wall surface 201. Therefore, the drainage from the louver 14 to the joint 12 or the tube wall surface 201 can obtain the drainage effect similar to that of the first and second embodiments described above. That is, the heat exchanger 1 of FIG. 29 can also promote the drainage from the louver 14. When the drainage from the louver 14 is promoted, as with the first and second embodiments described above, a reduction in the performance of the heat exchanger 1 can be prevented, and an increase in the air flow resistance of the heat exchanger 1 can be prevented by a reduction in the water film thickness in the louver 14.

In each of the embodiments described above, the heat exchanger 1 is used as the evaporator but is not limited thereto. The heat exchanger 1 in each of the embodiments may be a heat exchanger other than the evaporator as long as the heat exchanger requires drainage of water.

For example, instead of the evaporator, the heat exchanger 1 may be a heat exchanger provided in an environment exposed to water. As a specific example, a condenser and a radiator for air conditioning installed in an engine room of a vehicle may be exposed to water during travel of the vehicle or the like, and therefore correspond to the heat exchanger provided in the environment exposed to water.

In each of the embodiments described above, the first fluid flowing through the tube 20 is the refrigerant but can be a fluid other than the refrigerant. Moreover, the second fluid flowing among the tubes 20 is the air but can be a fluid other than the air.

In the first embodiment described above, as illustrated in FIGS. 3 and 5, for example, the hydrophilic recesses and projections 12*a* to 15*a* on the surface of the corrugated fin 10 are formed over the entire surface of the corrugated fin 10, but can also be formed on a part of the surface. This is because the hydrophilicity and drainage can be improved as compared with the case where the hydrophilic recesses and projections 12*a* to 15*a* are not formed at all.

For example, the hydrophilic recesses and projections 12*a* to 15*a* can be formed not on the surfaces at both sides in the thickness direction of the corrugated fin 10 but on only surface at one side in the thickness direction thereof. That is, as for the louver ends 142 and 143, each of the louver ends 142 and 143 need only have the corresponding hydrophilic recesses and projections 142*a* or 143*a* on at least one side in the thickness direction of the louver end 142 or 143. As for the curved connection 131, the curved connection 131 need only have the hydrophilic recesses and projections 131*a* on at least one side in the thickness direction of the curved connection 131. As for the louver body portion 141, the louver body portion 141 need only have the hydrophilic recesses and projections 141*a* on at least one side in the thickness direction of the louver body portion 141.

Figure 30:
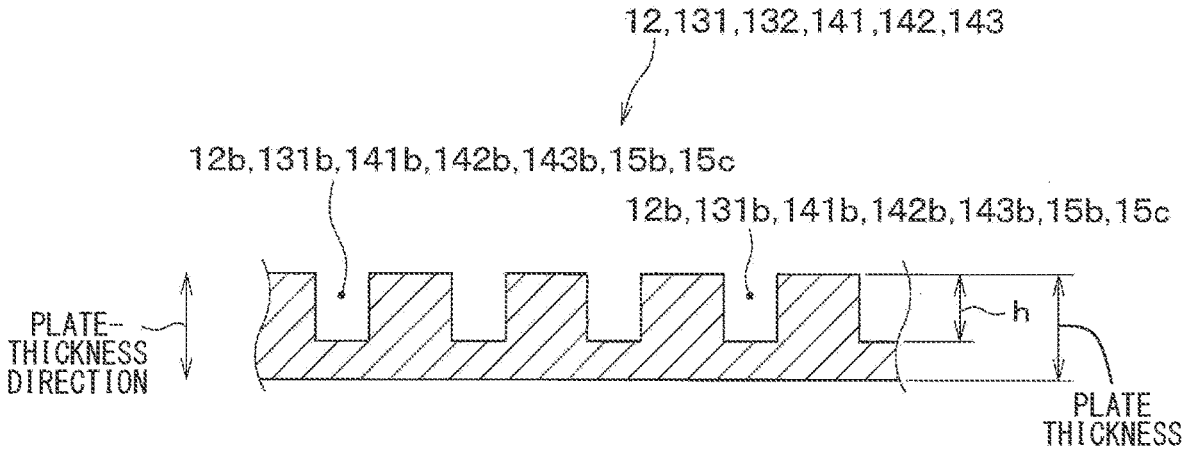
FIG. 30 is a cross-sectional view corresponding to FIG. 5 and schematically illustrating an example of the configuration in which a plurality of grooves for increasing the hydrophilicity of a surface is formed only on the surface of the corrugated fin at one side in the thickness direction thereof, as a modification of each embodiment.

For example, in the configuration in which the hydrophilic recesses and projections 12*a* to 15*a* are formed only on the surface at one side in the thickness direction of the corrugated fin 10, the hydrophilic recesses and projections 12*a* to 15*a* can be formed as illustrated in FIG. 30. In FIG. 30, the groove depth h of the plurality of grooves 12*b* to 15*c* forming the hydrophilic recesses and projections 12*a* to 15*a* is set to one-half or more of the thickness of the portion where the grooves 12*b* to 15*c* are formed.

As another point of view, the hydrophilic recesses and projections 12*a* to 15*a* can be formed only on specific portions of the corrugated fin 10. For example, the hydrophilic recesses and projections 12*a* to 15*a* may be provided on only one of the one louver end 142 and the other louver end 143 of the corrugated fin 10, and need not be provided on the other portions.

That is, as illustrated in FIG. 26, the fourth embodiment in which the hydrophilic recesses and projections 142*a* and 143*a* are provided only on both of the louver ends 142 and 143 is one example, and, in another example, the hydrophilic recesses and projections 142*a* or 143*a* only need be provided on one of the louver ends 142 and 143. In short, the louver end 142 or 143 of the louver 14 provided on at least one end in the tube arrangement direction DRst need only have the hydrophilic recesses and projections 142*a* or 143*a*. In other words, at least one of the one louver end 142 and the other louver end 143 only need have the corresponding hydrophilic recesses and projections 142*a* and 143*a*.

In the first embodiment described above, as illustrated in area B1 of FIG. 5 and FIG. 21, the one surface groove and the other surface groove of the plurality of grooves 12*b* to 15*c* of the corrugated fin 10 are in the alternate arrangement in a part of the corrugated fin 10, which is one example. In another example, the one surface groove and the other surface groove may be in the alternate arrangement throughout the corrugated fin 10.

In the third embodiment described above, as illustrated in FIG. 24, the notch 131*c* of the curved connection 131 is provided to correspond to some of the plurality of the louver gaps 14*c* formed in the fin body 13, which is one example. In another example, the notch 131*c* may be disposed to correspond to all of the plurality of louver gaps 14*c* formed in the fin body 13 and may be provided for each of the louver gaps 14*c*.

In the fifth embodiment described above, as illustrated in FIG. 27, the plurality of hydrophilic grooves 16*a* and 16*b* of the tube side ridge 16 satisfies both the relationship in magnitude between the groove depths DPa and DPb expressed as "DPa<DPb" and the relationship in magnitude between the groove widths WDa and WDb expressed as "WDa>WDb". This, however, is one example. In another example, one of the relationship in magnitude between the groove depths DPa and DPb and the relationship in magnitude between the groove widths WDa and WDb may be satisfied, and the other need not be satisfied.

In each of the embodiments described above, as illustrated in FIG. 3, for example, the corrugated fin 10 has the louvers as the cut-raised portions 14 for promoting heat transfer, but the cut-raised portions 14 may be something other than the louvers as illustrated in FIGS. 31 to 34, for example.

Figure 31:
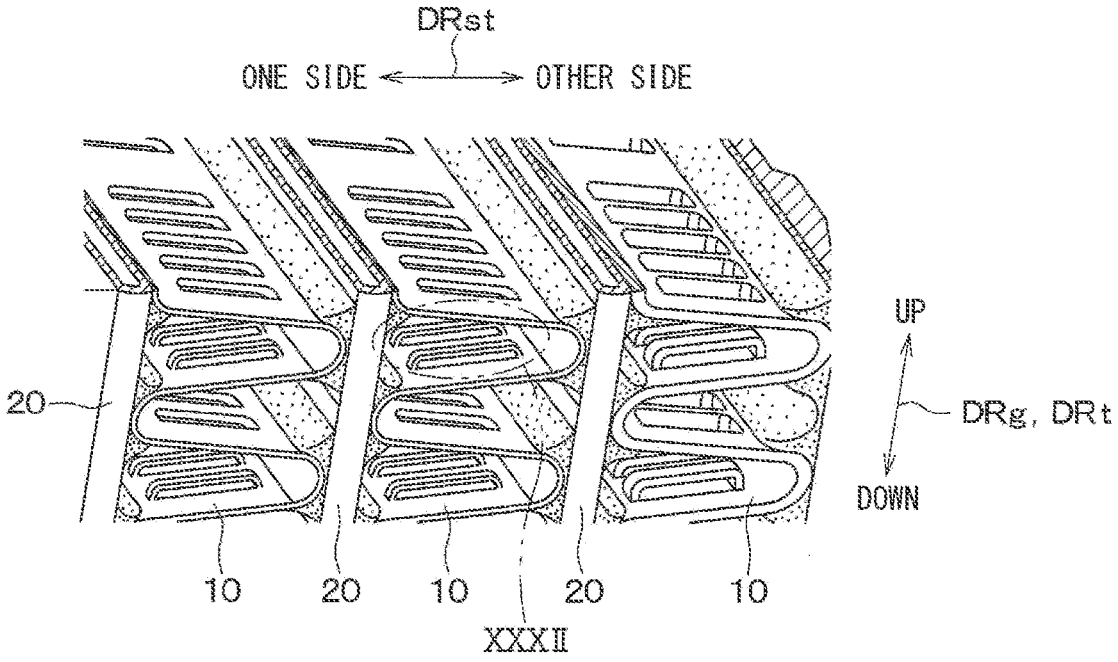
FIG. 31 is a view illustrating a heat exchanger having a slit fin as a modification of each embodiment, and is an enlarged perspective view of a part of a tube and a corrugated fin of the heat exchanger.
Figure 32:
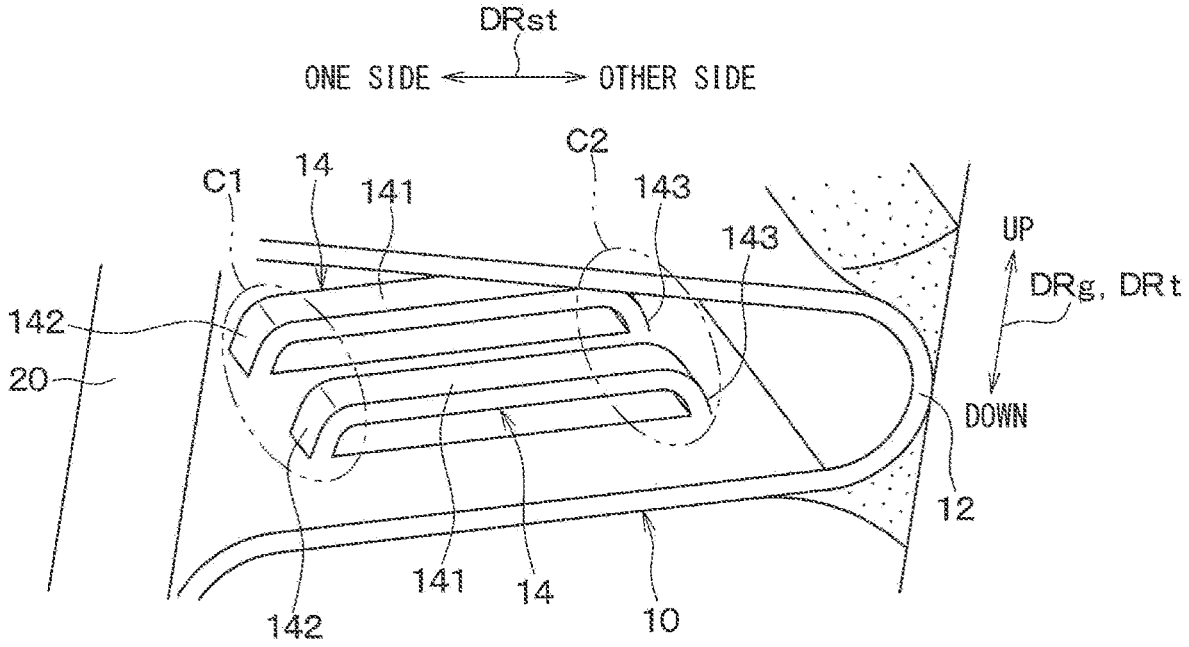
FIG. 32 is an enlarged view of area XXXII in FIG. 31.

Specifically, FIGS. 31 and 32 illustrate a slit fin in which the cut-raised portion 14 forms a slit. In the slit fin, hydrophilic recesses and projections 142*a* and 143*a* are formed at cut-raised ends 142 and 143, for example. That is, the hydrophilic recesses and projections 142*a* and 143*a* are formed in area C1 and area C2 of FIG. 32.

Figure 33:
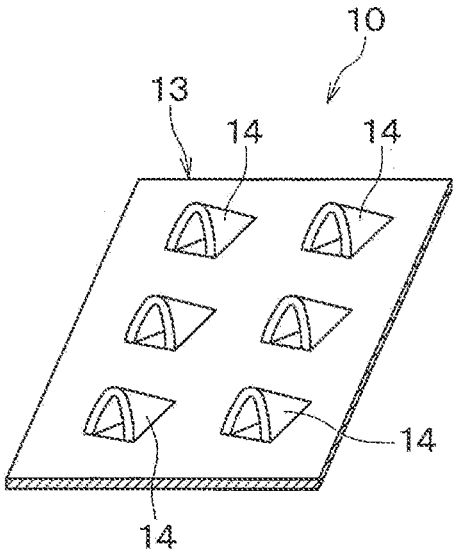
FIG. 33 is a perspective view illustrating a triangular fin as a modification of each embodiment, and is a view extracting and illustrating a cut-raised portion of the triangular fin and the periphery thereof.

FIG. 33 illustrates a triangular fin in which the cut-raised portion 14 forms a triangular vent. Also in the triangular fin, the hydrophilic recesses and projections 142*a* and 143*a* are formed as in the slit fin described above. FIG. 33 illustrates the cut-raised portion 14 and its periphery being extracted, and does not illustrate the wave shape of the corrugated fin 10.

Figure 34:
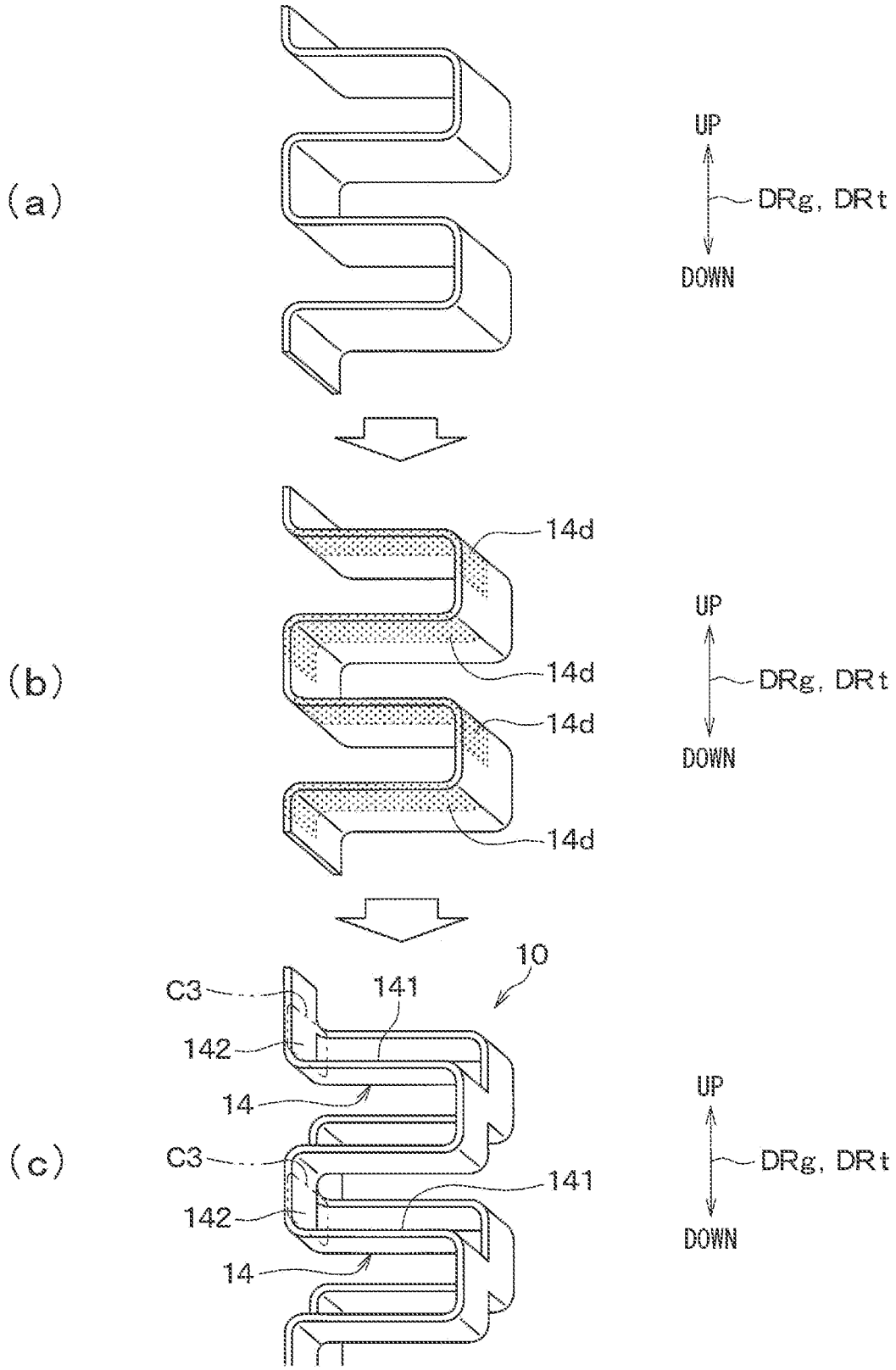
FIG. 34 is a perspective view illustrating an offset fin as a modification of each embodiment, and simply illustrating a process of manufacturing the offset fin.

FIG. 34 illustrates an offset fin in which the cut-raised portion 14 is formed by shifting a part of the wave shape to be offset. In the offset fin, as illustrated in (c) of FIG. 34, the hydrophilic recesses and projections 142*a* is formed in the one cut-raised end 142. That is, the hydrophilic recesses and projections 142*a* is formed in area C3 illustrated in (c) of FIG. 34. A finished product of the offset fin is illustrated in (c) of FIG. 34, and (a), (b), and (c) of FIG. 34 as a whole illustrate a process of manufacturing the offset fin. That is, a corrugated fin material that has the wave shape is prepared first as illustrated in (a) of FIG. 34, and then, as illustrated in (b) of FIG. 34, a portion 14*d* of the fin material which is dot-hatched and is to be the cut-raised portion 14 is cut-raised to be offset with respect to the other portions. As a result, the offset fin illustrated in (c) of FIG. 34 is obtained.

As one can see, each of the slit fin in FIGS. 31 and 32, the triangular fin in FIG. 33, and the offset fin in FIG. 34 described above has the wave shape and thus is a kind of the corrugated fin 10. Moreover, in each of the corrugated fins 10 in FIGS. 31 to 34, the hydrophilic recesses and projections 12*a* to 15*a* may be formed not only at the cut-raised ends 142 and 143 but throughout the corrugated fin 10.

The present disclosure is not limited to the above embodiments but can be modified in various ways for implementation. The above embodiments are not independent of one another but can be combined as appropriate unless clearly not combinable. It goes without saying that the components included in the above embodiments are not necessarily required unless specified as being required, regarded as being clearly required in principle, or the like.

The numerical value such as the number, the numerical value, the quantity, the range, or the like of a component mentioned in the above embodiments is not limited to a specific number unless specified as being required, clearly limited to such a specific number in principle, or the like. The material, the shape, the positional relationship, and the like of a component or the like mentioned in the above embodiments are not limited to those being mentioned unless otherwise specified, limited to specific material, shape, positional relationship, and the like in principle, or the like.

According to a first aspect illustrated in part or all of the above embodiments, tubes through which a first fluid flows are arranged in one direction. A cut-raised portion of a corrugated fin includes a cut-raised body that guides the second fluid, and a cut-raised end. The cut-raised end is provided on at least one end of the cut-raised portion in the one direction and has a plate shape extending from the cut-raised body. The cut-raised end has recesses and projections that increase hydrophilicity of a surface of the cut-raised end on at least one side of the cut-raised end in a thickness direction of the cut-raised end.

According to a second aspect, the cut-raised end is provided on each of opposite ends of the cut-raised portion in the one direction. As describe above, the cut-raised end has the recesses and projections on the at least one side of the cut-raised end in the thickness direction. As a result, the water adhering to the cut-raised portion is less likely to be stagnant due to the improvement in the hydrophilicity of the surface at each of both ends of the cut-raised portion. Therefore, as compared with the configuration of the first aspect, it is easier to prevent the water from being stagnant in the cut-raised portion of the corrugated fin.

According to a third aspect, the fin body includes a pair of curved connections that are curved and connected to the joints at opposite ends of the fin body in the one direction. The pair of curved connections each includes recesses and projections that increase hydrophilicity of a surface of the curved connection on at least one side of the curved connection in a thickness direction of the curved connection. Thus, since the hydrophilicity of the surface of the curved connections becomes high, the drainage from the curved connections to the joint or the tube wall surface can be promoted.

According to a fourth aspect, the cut-raised end provided on at least one end of the cut-raised portion in the one direction includes one cut-raised end that is provided at an end of the cut-raised portion on one side of the cut-raised portion in the one direction. The recesses and projections of the one cut-raised end includes a plurality of grooves, and the recesses and projections of one of the pair of curved connections closer to the one cut-raised end also includes a plurality of grooves. At least one of the plurality of grooves of the one cut-raised end is connected to at least one of the plurality of grooves of the one of the pair of curved connections. As a result, the water adhering to the one cut-raised end is more easily pulled to one of the curved connections, so that the drainage from the cut-raised portion can be promoted. Thus, the drainage from the cut-raised portion to the joint or the tube wall surface via the one curved connection can be promoted.

According to a fifth aspect, the fin body includes a pair of curved connections curved and connected to the joints at opposite ends of the fin body in the one direction. The fin body includes a cut-raised gap that is provided adjacent to the cut-raised portion by formation of the cut and raised shape of the cut-raised portion. At least one of the pair of curved connections has a notch extending thereinto from the cut-raised gap. The notch extends outward of a width of the cut-raised portion in the one direction. Thus, a notched portion of the notch can also be used as a drainage path so that drainage of a region near the notched portion can be performed smoothly.

According to a sixth aspect, the joint includes recesses and projections provided on a surface of the joint facing away from the joined tube for increase in hydrophilicity of the surface of the joint. Thus, the drainage is less likely to be stagnant at the joint, whereby the drainage from the cut-raised portion to the joint can be promoted.

According to a seventh aspect, the corrugated fin includes a tube side ridge that includes the joint and a portion adjacent to the joint, and the tube side ridge is curved to have a convex surface joined to the tube. The tube side ridge includes a plurality of hydrophilic grooves on the convex surface and a concave surface on the backside of the convex surface for increase in hydrophilicity of the convex and concave surfaces of the tube side ridge. The plurality of hydrophilic grooves on the convex surface has a groove depth smaller than a groove depth of the plurality of hydrophilic grooves on the concave surface.

Thus, the hydrophilic grooves of the tube side ridge generate the capillary force of "convex surface<concave surface", whereby the water is more easily collected on the surface on the concave surface of the tube side ridge to be the drainage path. As a result, the water is drained smoothly from the heat exchanger. Moreover, the recesses and projections on the surface can be made to be small on the convex surface of the tube side ridge joined to the tube, whereby the corrugated fin can be reliably joined to the tube.

According to an eighth aspect, the corrugated fin includes a tube side ridge that includes the joint and a portion adjacent to the joint, and the tube side ridge is curved to have a convex surface joined to the tube. The tube side ridge includes a plurality of hydrophilic grooves on the convex surface and a concave surface on a backside of the convex surface for increase in hydrophilicity of the convex and concave surfaces of the tube side ridge. The plurality of hydrophilic grooves on the convex surface has a groove width wider than a groove width of the plurality of hydrophilic grooves on the concave surface.

Thus, similar to the seventh aspect, the water is more easily collected on the surface on the concave surface of the tube side ridge, whereby the corrugated fin can be reliably joined to the tube.

According to a ninth aspect, the cut-raised body includes recesses and projections that increase hydrophilicity of a surface of the cut-raised body on at least one side in a thickness direction of the cut-raised body. Thus, the water spreads on the surface of the cut-raised body and flows out more easily from the cut-raised portion, whereby the drainage from the cut-raised portion can be improved.

According to a tenth aspect, the second fluid flows between the tubes in one cross direction crossing the one direction from one side as an upstream side to another side as a downstream side. The fin body includes a flat surface along the one cross direction. The flat surface includes a plurality of longitudinal grooves that increase hydrophilicity of the flat surface, and the plurality of longitudinal grooves extends in the one direction. The longitudinal grooves thus pull the water adhering on the flat surface in the one direction, whereby the water is easily led to a tube adjacent to the corrugated fin. Therefore, the drainage from the flat surface can be improved.

According to an eleventh aspect, the flat surface includes a plurality of lateral grooves that increase hydrophilicity of the flat surface, and the plurality of lateral grooves crosses the plurality of longitudinal grooves and extends in the one cross direction. The water adhering on the flat surface thus wets and spreads while being pulled by the longitudinal and lateral grooves, and is drained to the area around the flat surface. Since the plurality of longitudinal grooves and the plurality of lateral grooves intersect one another, a wide variety of drainage paths is formed on the flat surface so that the drainage from the flat surface can be improved.

According to a twelfth aspect, the flat surface includes a plurality of lateral grooves that increase hydrophilicity of the flat surface, and the plurality of lateral grooves extends in the one cross direction. Thus, the hydrophilicity of the flat surface is improved by the lateral grooves so that the drainage from the flat surface can be improved.

According to a thirteenth aspect, the second fluid is a gas that generates condensed water by heat exchange with the first fluid.

According to a fourteenth aspect, the heat exchanger is provided in an environment to be exposed to water.

According to a fifteenth aspect, the tubes extend in a vertical direction. Therefore, the drainage of the water along the tube wall surface can be improved by gravity.

According to a sixteenth aspect, a depth of a recess included in the recesses and projections is 10 μm or deeper. As a result, the hydrophilicity is gained sufficiently by the recesses and projections, and the drainage effect of draining the water adhering to the surface with the recesses and projections can be sufficiently exerted.

According to a seventeenth aspect, a depth of a groove included in the plurality of longitudinal grooves is 10 μm or deeper, and a depth of a groove included in the plurality of lateral grooves is 10 μm or deeper. As a result, the hydrophilicity is gained sufficiently by the longitudinal grooves and the lateral grooves, and the drainage effect of draining the water adhering to the flat surface can be sufficiently exerted.

According to an eighteenth aspect, the recesses and projections of the cut-raised end are provided on each of opposite sides of the cut-raised end in the thickness direction. Thus, as compared with the case where the recesses and projections is provided only on one side in the thickness directions of the cut-raised end, a greater effect of preventing stagnation of the water in the cut-raised portion of the corrugated fin can be obtained.

According to a nineteenth aspect, the cut-raised portion for promoting heat transfer is a louver.

According to a twentieth aspect, a cut-raised portion of a corrugated fin includes a cut-raised body that guides a second fluid, and a cut-raised end that is provided on at least one end of the cut-raised portion in one direction and has a plate shape extending from the cut-raised body. The cut-raised end has recesses and projections that increase hydrophilicity of a surface of the cut-raised end on at least one side of the cut-raised end in a thickness direction of the cut-raised end.

A comparative example will be described. A heat exchanger according to the comparative example is a plate-fin and tube heat exchanger, and flat tubes are inserted into notches formed in a flat plate fin.

On the surface of the plate fin, recesses and projections may be formed to improve hydrophilicity of the surface of the plate fin. As a result, condensed water is drained quickly along the plate fin.

When the condensed water is generated in the heat exchanger and stagnates therein, the heat exchange performance may be deteriorated. As a result, such deterioration may cause, for example, an increase in noise, an increase in power consumption of a blower feeding air to the heat exchanger, an increase in power of a compressor connected to the heat exchanger in a refrigeration cycle, and the like.

On the other hand, a heat exchanger including corrugated fins with louvers has a different drainage path from that of the plate-fin and tube heat exchanger. Moreover, the corrugated fins improve the heat exchange performance by guiding the fluid passing between tubes with the louvers of the corrugated fins. Therefore, the technology of the comparative example for improvement of hydrophilicity of the surface of the plate fin cannot be used as it is for the heat exchanger including the corrugated fins. The present inventors have found the above facts as a result of detailed study.

According to one aspect of the present disclosure, a heat exchanger performs heat exchange between a first fluid and a second fluid. The heat exchanger includes tubes which are arranged in one direction and in which the first fluid flows, and a corrugated fin provided between the tubes, curved to have a wave shape, and configured to promote heat exchange between the first fluid and the second fluid. The second fluid flows between the tubes. The corrugated fin includes joints that are joined to the tubes, and fin bodies that are each between and connect the joints which are located next to each other along the wave shape. The fin body includes a cut-raised portion that has a shape in which a part of the fin body is cut and raised for promotion of heat transfer. The cut-raised portion includes a cut-raised body that guides the second fluid, and a cut-raised end that is provided on at least one end of the cut-raised portion in the one direction and has a plate shape extending from the cut-raised body. The cut-raised end has recesses and projections that increase hydrophilicity of a surface of the cut-raised end on at least one side of the cut-raised end in a thickness direction of the cut-raised end.

Thus, since the hydrophilicity of the surface of the cut-raised end becomes high, the water adhering to the cut-raised portion is less likely to be stagnant at the cut-raised end and is quickly drained to the joint or the surface of the tube of the corrugated fin. Therefore, the water can be prevented from stagnating in the cut-raised portion of the corrugated fin. As a result, for example, the function of the cut-raised portion for guiding the second fluid is not hindered by the water adhering to the cut-raised portion.

According to another aspect of the present disclosure, a corrugated fin is for a heat exchanger performing heat exchange between a first fluid and a second fluid. The corrugated fin is disposed between tubes arranged in one direction, is curved to form a wave shape, and promotes the heat exchange between the first fluid flowing through the tubes and the second fluid flowing between the tubes. The corrugated fin includes joints joined to the tubes, and fin bodies that are each between and connect the joints which are located next to each other along the wave shape. The fin body includes a cut-raised portion that has a shape in which a part of the fin body is cut and raised for promotion of heat transfer. The cut-raised portion includes a cut-raised body that guides the second fluid, and a cut-raised end that is provided on at least one end of the cut-raised portion in the one direction and has a plate shape extending from the cut-raised body. The cut-raised end has recesses and projections that increase hydrophilicity of a surface of the cut-raised end on at least one side of the cut-raised end in a thickness direction of the cut-raised end.

Therefore, the effect similar to that of the heat exchanger according to the one aspect above can be obtained.

What is claimed is:

1. A heat exchanger that performs heat exchange between a first fluid and a second fluid, the heat exchanger comprising:

tubes which are arranged in one direction and in which the first fluid flows; and a corrugated fin provided between the tubes, curved to have a wave shape, and configured to promote heat exchange between the first fluid and the second fluid, the second fluid flowing between the tubes, wherein the corrugated fin includes joints that are joined to the tubes, and fin bodies that are each between and connect the joints which are located next to each other along the wave shape, the fin body includes a cut-raised portion that has a shape in which a part of the fin body is cut and raised for promotion of heat transfer, the cut-raised portion includes a cut-raised body that guides the second fluid, and a cut-raised end that is provided on at least one end of the cut-raised portion in the one direction and has a plate shape extending from the cut-raised body, the cut-raised end has recesses and projections that increase hydrophilicity of a surface of the cut-raised end on at least one side of the cut-raised end in a thickness direction of the cut-raised end, the recesses and projections of the cut-raised end are configured to promote drainage of water toward the joint or a surface of the tube, the fin body includes curved connections curved and connected to the joints at opposite ends of the fin body in the one direction, the fin body includes a cut-raised gap that is provided adjacent to the cut-raised portion by formation of the cut and raised shape of the cut-raised portion, at least one of the curved connections has a notch extending from the cut-raised gap, and the notch extends outward of a range of the cut-raised portion in the one direction.

2. The heat exchanger according to claim 1, wherein the curved connections each includes recesses and projections that increase hydrophilicity of a surface of the curved connection on at least one side of the curved connection in a thickness direction of the curved connection.

3. The heat exchanger according to claim 2, wherein the cut-raised end provided on at least one end of the cut-raised portion in the one direction includes one cut-raised end that is provided at an end of the cut-raised portion on one side of the cut-raised portion in the one direction, the recesses and projections of the one cut-raised end includes a plurality of grooves, and the recesses and projections of one of the curved connections closer to the one cut-raised end also includes a plurality of grooves, and at least one of the plurality of grooves of the one cut-raised end is connected to at least one of the plurality of grooves of the one of the curved connections.

4. The heat exchanger according to claim 1, wherein the second fluid is a gas that generates condensed water by heat exchange with the first fluid.

5. The heat exchanger according to claim 1, being provided in an environment to be exposed to water.

6. The heat exchanger according to claim 1, wherein the tubes extend in a vertical direction.

7. The heat exchanger according to claim 1, wherein a depth of a recess included in the recesses and projections is 10 μm or deeper.

8. The heat exchanger according to claim 1, wherein the recesses and projections of the cut-raised end are provided on each of opposite sides of the cut-raised end in the thickness direction.

9. The heat exchanger according to claim 1, wherein the cut-raised portion for promoting heat transfer is a louver.

10. A corrugated fin for a heat exchanger performing heat exchange between a first fluid and a second fluid, the corrugated fin being disposed between tubes arranged in one direction, being curved to form a wave shape, and promoting the heat exchange between the first fluid flowing through the tubes and the second fluid flowing between the tubes, the corrugated fin comprising:

joints joined to the tubes; and fin bodies that are each between and connect the joints which are located next to each other along the wave shape, wherein the fin body includes a cut-raised portion that has a shape in which a part of the fin body is cut and raised for promotion of heat transfer, the cut-raised portion includes a cut-raised body that guides the second fluid, and a cut-raised end that is provided on at least one end of the cut-raised portion in the one direction and has a plate shape extending from the cut-raised body, the cut-raised end has recesses and projections that increase hydrophilicity of a surface of the cut-raised end on at least one side of the cut-raised end in a thickness direction of the cut-raised end, the recesses and projections of the cut-raised end are configured to promote drainage of water toward the joint or a surface of the tube, the fin body includes curved connections curved and connected to the joints at opposite ends of the fin body in the one direction, the fin body includes a cut-raised gap that is provided adjacent to the cut-raised portion by formation of the cut and raised shape of the cut-raised portion, at least one of the curved connections has a notch extending from the cut-raised gap, and the notch extends outward of a range of the cut-raised portion in the one direction.

* * * * *